US005429915A

United States Patent [19]

Shibahara et al.

[11] Patent Number: 5,429,915

[45] Date of Patent: Jul. 4, 1995

[54] SILVER HALIDE COLOR PHOTOGRAPHIC LIGHT-SENSITIVE MATERIAL COMPRISING A RED-SENSITIVE SILVER HALIDE EMULSION LAYER UNIT HAVING AT LEAST 3 SUBLAYERS OF DIFFERENT SENSITIVITY

[75] Inventors: Yoshihiko Shibahara; Kei Sakanoue, both of Minami-ashigara, Japan

[73] Assignee: Fuji Photo Film Co., Ltd., Japan

[21] Appl. No.: 135,418

[22] Filed: Oct. 13, 1993

[30] Foreign Application Priority Data

Oct. 20, 1992 [JP] Japan ..... 4-306242

[51] Int. Cl.[6] ..... G03C 1/46

[52] U.S. Cl. ..... 430/506; 430/552; 430/553; 430/556; 430/557; 430/558; 430/503; 430/544; 430/567

[58] Field of Search ..... 430/506, 503, 504, 502, 430/567, 553, 552, 557, 556, 505, 558, 544

[56] References Cited

U.S. PATENT DOCUMENTS 4,170,479 10/1979 Usami ..... 430/506
4,567,135 1/1986 Arakawa et al. ..... 430/557
4,963,465 10/1990 Matejec et al. ..... 430/506

FOREIGN PATENT DOCUMENTS 59-64843 4/1984 Japan .
3265845 11/1991 Japan .
439655 2/1992 Japan .

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

A silver halide color photographic light-sensitive material has red-, green-, and blue-sensitive silver halide emulsion layers, and the red-sensitive emulsion layer contains a cyan coupler and a yellow coupler with a relative coupling rate of 0.7 to 3.0 with respect to the cyan coupler. In addition, at least one layer may contain a specific DIR compound, the average silver iodide content of a silver halide emulsion contained in the red-sensitive silver halide emulsion may be higher than that of a silver halide emulsion contained in the green-sensitive silver halide emulsion layer, or at least one layer may contain a monodisperse silver halide grain emulsion with a grain diameter/grain thickness ratio of 2 to 8.

7 Claims, No Drawings

SILVER HALIDE COLOR PHOTOGRAPHIC LIGHT-SENSITIVE MATERIAL COMPRISING A RED-SENSITIVE SILVER HALIDE EMULSION LAYER UNIT HAVING AT LEAST 3 SUBLAYERS OF DIFFERENT SENSITIVITY

BACKGROUND OF THE INVENTION

1. Field of the Invention

The present invention relates to a silver halide color photographic light-sensitive material and, more particularly, to a silver halide color photographic light-sensitive material improved in color reproduction and color temperature dependency.

2. Description of the Related Art

Recently, requirements for the performance of color photographic light-sensitive materials have become strict increasingly, and so a demand has arisen for improvements in many-sided and total photographic characteristics, such as a high sharpness, a smooth graininess, and a vivid and high-fidelity color reproduction.

To obtain a more vivid color reproduction, so-called masking or an interlayer (interimage) effect, such as disclosed in U.S. Pat. No. 2,521,908, has been used.

The interlayer effect is described in, e.g., Hanson et al., "Journal of The Optical Society of America," Vol. 42, pages 663 to 669, and A. Thiels, "Zeitshriftfut Wissenschaftliche Photographie, Photophysique und Photochemie," Vol. 47, pages 106 to 118 and 246 to 255.

As means of enhancing the interlayer effect, there is a method of using a so-called DIR coupler which releases a development inhibitor upon reacting with the oxidized form of a developing agent. The DIR coupler is a coupler with a coupling active position to which a group which splits off from the coupling active position to achieve a development inhibiting effect or a precursor of that group is introduced. Practical examples of the DIR coupler are described in, e.g., U.S. Pat. Nos. 3,227,554, 3,701,783, 3,615,506, and 3,617,291.

U.S. Pat. No. 3,536,486 describes a method of obtaining the interlayer effect by introducing diffusive 4-thiazoline-2-thione to an exposed color reversal photographic constituting element. U.S. Pat. No. 3,536,487 describes a method of obtaining the interlayer effect by introducing diffusive 4-thiazoline-2-thione to an unexposed color reversal photographic constituting element.

JP-B-48-34169 ("JP-B" means Published Examined Japanese Patent Application) describes that a remarkable interlayer effect appears when a silver halide is reduced to silver by developing a color photographic material in the presence of a N-substituted-4-thiazoline-2-thione compound.

Research Disclosure No. 13116 (March, 1975) describes that the interlayer effect can be obtained by forming a layer containing colloidal silver between a cyan layer and a magenta layer in a color reversal photographic constituting element.

In addition, U.S. Pat. No. 4,082,553 describes a method of obtaining the interlayer effect in a color reversal photographic material with a layer arrangement which allows iodine ions to move during development. In this method, latent image-forming silver haloiodide grains are added to one layer of the material, and latent image-forming silver halide grains and silver halide grains which are surface-fogged so that the grains can be developed independently of image exposure are added to another layer, thereby obtaining the interlayer effect.

Using a DIR compound in order to improve sharpness, particularly an edge effect is presently, commonly performed. A DIR compound generally used is a DIR coupler which imagewise releases a development inhibitor through a coupling reaction with the oxidized form of a color developing agent, thereby forming a color dye.

When the DIR coupler is used, however, unclear colors result if a dye produced by the coupling reaction differs from a dye that is obtained from a main coupler, and this is unpreferred in color reproduction. To prevent this problem, it is necessary to develop DIR couplers with hues equivalent to those of main couplers of yellow, magenta, and cyan. That is, three types of DIR couplers with optimal reactivities must be developed, resulting in increases in costs for both development and synthesis. For this reason, development of a colorless compound-forming DIR compound has been desired.

The colorless compound-forming DIR compound is classified into two types, a coupling type and an oxidation-reduction type, in accordance with the way the compound reacts with the oxidized form of a color developing agent. Examples of the coupling type colorless compound-forming DIR compound are described in JP-B-51-16141, JP-B-51-16142, and U.S. Pat. Nos. 4,226,943 and 4,171,223. Examples of the oxidation-reduction type colorless compound-forming DIR compound are DIR hydroquinone compounds described in U.S. Pat. Nos. 3,379,529 and 3,639,417, JP-A-49-129536 ("JP-A" means Published Unexamined Japanese Patent Application), JP-A-64-546, and JP-A-3-226744, and DIR hydrazide compounds described in JP-A-61-213847, JP-A-64-88451, and U.S. Pat. No. 4,684,604. When the DIR compound of the above sort is applied to a color reversal light-sensitive material whose processing step includes B/W development (1st development) and color development (2nd development), it is preferable that the DIR compound release a development inhibitor in the 1st development for the reason explained below. That is, since the 2nd development aims to rapidly develop all of silver halides that are not developed in the 1st development, the silver developing rate in the 2nd development is very high. Therefore, attempting to obtain the development inhibiting effect imagewise in the 2nd development slows down the development of silver, causing the processing to become unstable in color development. For this reason, the DIR compound is preferably reacted in the 1st development. In this case, it is essential to use the oxidation-reduction type DIR compound capable of also reacting with the oxidized form of a developing agent for B/W development.

Controlling the interlayer effect by changing the silver iodide contents of silver halide emulsions contained in individual layers has also been conventionally, widely performed. As an example, JP-A-4-29238 discloses a method of enhancing the interlayer effect by increasing the silver iodide contents of low-speed layers.

Although the color reproduction, and particularly the saturation of a color photographic light-sensitive material can be improved by enhancing the interlayer effect as described above, another problem of an increase in color temperature dependency arises. The color temperature dependency of a color photographic light-sensitive material appears as a change in color balance caused by a change in color temperature due to the season, the time, or the weather when photography of color pictures is performed, or as a difference in color balance between sunny and shadow portions of an object to be photographed. When the color temperature dependency is high, the difference in color balance increases to make appropriate color reproduction impossible.

As means of improving the fidelity of color reproduction, descriptions related to mixing of couplers which form colors with different hues (to be described later) are found occasionally. However, none of these conventional methods can simultaneously achieve the two objectives, the improvement in color saturation and the improvement in color temperature dependency, that rather conflict with each other.

SUMMARY OF THE INVENTION

It is an object of the present invention to provide a silver halide color photographic light-sensitive material which is improved in color reproduction, particularly color saturation, and is also improved in color temperature dependency.

According to a first aspect of the present invention, there is provided a silver halide color photographic light-sensitive material comprising red-, green-, and blue-sensitive silver halide emulsion layers on a support, wherein the red-sensitive emulsion layer comprises three or more sublayers with different speeds, and at least one red-sensitive emulsion sublayer contains a cyan coupler and a yellow coupler with a relative coupling rate of 0.7 to 3.0 with respect to the cyan coupler.

According to a second aspect of the present invention, there is provided a silver halide color photographic light-sensitive material comprising red-, green-, and blue-sensitive silver halide emulsion layers on a support, wherein at least one layer contains a compound represented by Formula (I) below, and at least one red-sensitive emulsion layer contains a cyan coupler and a yellow coupler with a relative coupling rate of 0.7 to 3.0 with respect to the cyan coupler:

Formula (I)

$$A(L)_n\text{-}(G)_m\text{-}(Time)_t\text{-}X$$

where A represents an oxidation-reduction (redox) nucleus or its precursor, which is an atomic group which allows $(Time)_t$-X to split off when oxidized during photographic development, Time represents a group which releases X after splitting off from an oxidized form of A, X represents a development inhibitor, L represents a divalent linking group, G represents a polarizable group, and each of n, m, and t represents 0 or 1.

According to a third aspect of the present invention, there is provided a silver halide color photographic light-sensitive material comprising red-, green-, and blue-sensitive silver halide emulsion layers on a support, wherein an average silver iodide content of a silver halide emulsion contained in the red-sensitive silver halide emulsion layer is higher than an average silver iodide content of a silver halide emulsion contained in the green-sensitive silver halide emulsion layer, and the red-sensitive emulsion layer contains a cyan coupler and a yellow coupler with a relative coupling rate of 0.7 to 3.0 with respect to the cyan coupler.

According to a fourth aspect of the present invention, there is provided a silver halide color photographic light-sensitive material comprising red-, green-, and blue-sensitive silver halide emulsion layers on a support, wherein at least one layer contains a monodisperse silver halide grain emulsion with a grain diameter/grain thickness ratio of 2 to 8, and the red-sensitive emulsion layer contains a cyan coupler and a yellow coupler with a relative coupling rate of 0.7 to 3.0 with respect to the cyan coupler.

DETAILED DESCRIPTION OF THE PREFERRED EMBODIMENTS

The light-sensitive material of the present invention will be described in more detail below.

The light-sensitive material of the present invention contains a cyan coupler as a main coupler and a yellow coupler as an auxiliary coupler in a red-sensitive emulsion layer. The ratio of the yellow coupler to all the couplers contained in the red-sensitive emulsion layer is preferably 0.3 to 20 mol %, and more preferably 1 to 10 mol %. If the ratio is less than 0.3 mol %, the effect of the present invention cannot be achieved. If the ratio exceeds 20 mol %, the degree of unclear colors increases.

When the red-sensitive emulsion layer comprises a plurality of sublayers with different speeds, it is desirable that the amounts of the yellow coupler as an auxiliary coupler contained in sublayers with higher speeds be larger than those of the yellow coupler contained in sublayers with lower speeds. The ratio of the yellow coupler contained in a red-sensitive emulsion sublayer with the highest speed is preferably 2 to 30 mol %, and more preferably 5 to 20 mol %. The ratio of the yellow coupler contained in a red-sensitive emulsion sublayer with the lowest speed is preferably 0 to 10 mol %, and more preferably 0 to 5 mol %. The present inventors have found that a color temperature dependency can be improved sufficiently while the degree of unclear colors is minimized by adding larger amounts of the yellow coupler to sublayers with higher speeds than those to sublayers with lower speeds.

The yellow coupler added to the red-sensitive emulsion layer of the light-sensitive material of the present invention has a relative coupling rate of 0.7 to 3.0 with respect to the cyan coupler as a main coupler of the red-sensitive emulsion layer. The relative coupling rate is more preferably 0.8 to 2.5.

When the red-sensitive emulsion layer consists of a plurality of sublayers with different speeds and these sublayers contain different types of main couplers, the yellow coupler with the above relative coupling rate with respect to the coupling rate of a cyan coupler contained in a layer to which the yellow coupler is added is mixed in that layer. When the cyan coupler as a main coupler consists of two or more types of compounds in the same sublayer, the coupling rate of the cyan coupler is set to be equal to the weighted mean of the coupling rates of the individual couplers.

The relative coupling rate of a coupler can be measured by adding the coupler to be measured to an emulsion, developing the emulsion by using a color developing solution added with citrazinic acid, and measuring the color density. That is, a relative coupling rate RY/RC of a yellow coupler to a cyan coupler is represented by the following equation:

$$RY/RC = \log(1 - DY/DYmax)/\log(1 - DC/DCmax)$$

where DYmax is the maximum color density of the yellow coupler, DY is the color density of the yellow coupler in the middle of the processing, DCmax is the maximum color density of the cyan coupler, and DC is the color density of the cyan coupler in the middle of the processing.

More specifically, an emulsion containing couplers mixed is exposed in several different steps and color-developed, thereby obtaining several values of DY and DC. The relative coupling rate RY/RC is calculated from the slope of a straight line obtained by plotting these values of DY and DC as:

$$\log(1-D/Dmax)$$

on two orthogonal axes.

Note that a phenol type coupler, which is one type of the yellow and cyan couplers and has a ureido group at the 2-position, changes its reactivity or hue depending on the type or the amount of oil used, so it is unpreferable to evaluate the reactivity of this coupler in the presence of other couplers as described above. Therefore, the reactivity of the phenol type coupler as one of the yellow and cyan couplers and having a ureido group at the 2-position is evaluated as follows.

That is, a sample formed by adding a coupler of interest singly to an emulsion is exposed and color-developed, obtaining the maximum density of the resultant color dye image as (Do)max. An identical sample, on the other hand, is processed by using a color developing solution prepared by adding citrazinic acid in an amount of 1.5 g per liter of the solution, obtaining the maximum density of the resultant color dye image as (Dc)max.

In this case, a coupling color forming properties Rc/Ro of this coupler can be evaluated relatively by (Dc)max/(Do)max.

Next, the differences between the present invention and conventional examples using different types of couplers in the same emulsion layer will be described below.

Research Disclosure No. 18362 (July, 1979) and JP-A-53-133432 disclose that the reproduction of gray or black can be improved by providing a light-sensitive silver halide emulsion layer containing a coupler for forming a black color. The present invention, however, aims to improve the color reproduction without using any black coupler. In addition, JP-B-49-25901 discloses that the visual density of a black image can be increased by adding a coupler which absorbs light around 500 nm and forms a red color and a coupler which absorbs light around 600 nm and forms a blue color to low-speed emulsion layers, thereby burying the valleys of absorption of three colors, cyan, magenta, and yellow.

The present invention aims at improving the reproduction of shading in a high-density region by using only three color dyes of cyan, magenta, and yellow without impairing the saturation and the color reproduction in low- and medium-density regions and is therefore different from the above two prior arts.

In the case of a color paper or a color positive photographic material, the saturation in the low- and medium-density regions is not much degraded even when the blue and red couplers are added to low-speed emulsion layers. In the case of a color reversal film or a color reversal paper, however, unlike in the color paper or the color positive photographic material, the saturation in the low- and medium-density regions is degraded significantly when the blue and red couplers are added to low-speed emulsion layers. In the case of the color reversal film or the color reversal paper, therefore, it is impractical to add the blue and red couplers to low-speed emulsion layers.

U.S. Pat. No. 2,592,514 describes that the differences in hue of color images formed by main couplers can be corrected by adding cyan and magenta couplers, in addition to a yellow coupler, to a blue-sensitive silver halide emulsion layer, adding cyan and yellow couplers, in addition to a magenta coupler, to a green-sensitive silver halide emulsion layer, and adding yellow and magenta couplers, in addition to a cyan coupler, to a red-sensitive silver halide emulsion layer. JP-B-33-3481 discloses that unnatural colors can be improved by mixing color forming agents for forming colors different from those formed by original color forming agents, thereby adding halftone gray images to original color images.

JP-A-62-67537 discloses a method of improving the reproduction of shading in a high-density region without impairing the color reproduction by using an auxiliary coupler which has a relative coupling rate of 0.01 to 0.7 with respect to a main coupler and forms a color with a hue different from that of the main coupler. However, the invention of JP-A-62-67537 aims at improving the shading reproduction in particularly the high-density region of red or yellow and does not disclose that the color temperature dependency can be improved by using, as an auxiliary coupler, a yellow coupler with a relative coupling rate of 0.7 or more with respect to a main coupler. That is, the improvement of the color temperature dependency as the object of the present invention cannot be achieved by the auxiliary coupler with a relative coupling rate of less than 0.7 because the coupling activity of the coupler is too low. JP-A-62-67537 also does not disclose that the color saturation and the color temperature dependency can be improved simultaneously by forming a red-sensitive emulsion layer consisting of three or more sublayers with different speeds as in the first aspect of the present invention, by defining the silver iodide content of each individual layer within a certain range as in the third aspect of the present invention, or by using monodisperse tabular silver halide grains as in the fourth aspect of the present invention.

JP-A-3-265845 discloses a method of realizing a high-fidelity color reproduction by defining the spectral sensitivity distribution of a red-sensitive emulsion layer and adding a yellow coupler to the red-sensitive emulsion layer. In the invention of JP-A-3-265845, however, the fidelity of red reproduction is of primary concern, so the spectral sensitivity of the red-sensitive emulsion layer has a maximum sensitivity at a shorter wavelength, and the coupling rate of the yellow coupler is also not defined at all. JP-A-3-265845, therefore, has not reached the solution of the conflicting problems, the improvement in color saturation and the improvement in color temperature dependency, which is the object of the present invention. In addition, JP-A-3-265845 describes that the addition of the yellow coupler to low-speed layers is effective, which is different from the preferred embodiments of the present invention. JP-A-3-265845 also does not disclose that the color saturation and the color temperature dependency can be improved simultaneously by forming a red-sensitive emulsion layer consisting of three or more sublayers with different speeds as in the first aspect of the present invention, by using a hydroquinone compound capable of releasing a development inhibitor as in the second aspect of the present invention, by defining the silver iodide content of each individual layer within a certain range as in the third aspect of the present invention, or by using monodisperse tabular silver halide grains as in the fourth aspect of the present invention.

Finally, JP-A-3-255433 discloses a color light-sensitive material wherein a wavelength which gives a maximum sensitivity of the spectral sensitivity distribution of a blue-sensitive emulsion layer is 415 mm to 470 mm and a red-sensitive emulsion layer contains a yellow coupler. However, no coupling rate is specified for the yellow coupler in JP-A-3-255433, and the application method thereof is different from the present invention.

In the first aspect of the present invention, a red-sensitive emulsion layer consists of three or more sublayers with different speeds. It is desirable that the individual red-sensitive emulsion sublayers contain a yellow coupler at the following ratio:

$$X(RH) \geqq X(RM) \geqq X(RL)$$

where X(RH) is the content (mol %) of a yellow coupler with respect to all couplers contained in a red-sensitive emulsion sublayer with the highest speed, X(RM) is the content (mol %) of a yellow coupler with respect to all couplers contained in a red-sensitive emulsion sublayer with a medium speed, and X(RL) is the content (mol %) of a yellow coupler with respect to all couplers contained in a red-sensitive emulsion sublayer with the lowest speed.

Preferable ranges of X(RH), X(RM), and X(RL) are as follows.

$2\% \leqq X(RH) \leqq 30\%$
$0\% \leqq X(RM) \leqq 20\%$
$0\% \leqq X(RL) \leqq 10\%$ More preferable ranges of X(RH), X(RM), and X(RL) are as follows.

$5\% \leqq X(RH) \leqq 20\%$
$2\% \leqq X(RM) \leqq 15\%$
$0\% \leqq X(RL) \leqq 5\%$ The present inventors have found that the color temperature dependency can be improved, while the degree of unclear colors is kept low and a high color saturation is maintained, by increasing the mixing ratios of the yellow coupler in red-sensitive emulsion sublayers with higher speeds and decreasing them in red-sensitive emulsion sublayers with lower speeds.

In the light-sensitive material of the present invention, it is preferred that a green-sensitive emulsion layer and/or a blue-sensitive emulsion layer consist of three or more sublayers with different speeds. A practical example of the layer arrangement of the light-sensitive material of the present invention is presented below, but the invention is not limited to this example. That is, the layers are arranged from a support as follows:

1st layer: Antihalation layer
2nd layer: Interlayer
3rd layer: Interlayer (containing colloidal silver or fogged fine grain silver halide)
4th layer: Low-speed red-sensitive emulsion layer
5th layer: Medium-speed red-sensitive emulsion layer
6th layer: High-speed red-sensitive emulsion layer
7th layer: Interlayer
8th layer: Interlayer (containing colloidal silver or fogged fine grain silver halide)
9th layer: Low-speed green-sensitive emulsion layer
10th layer: Medium-speed green-sensitive emulsion layer
11th layer: High-speed green-sensitive emulsion layer
12th layer: Interlayer
13th layer: Yellow filter layer
14th layer: Low-speed blue-sensitive emulsion layer
15th layer: Medium-speed blue-sensitive emulsion layer
16th layer: High-speed blue-sensitive emulsion layer
17th layer: 1st protective layer
18th layer: 2nd protective layer
19th layer: 3rd protective layer When a light-sensitive layer consists of three or more sublayers sensitive to the same color and having different speeds, the ratios of silver coating amounts in the individual sublayers are preferably 15% to 40% in a high-speed layer, 20% to 50% in a medium-speed layer, and 20% to 50% in a low-speed layer assuming that the total silver amount of the whole light-sensitive layer is 100%. It is desirable that the coated silver amount of the high-speed layer be lower than those of the medium- and low-speed layers.

In the second aspect of the present invention, the light-sensitive material of the present invention contains a compound represented by Formula (I) below in at least one layer. A compound represented by Formula (I) is known to those skilled in the art and described in detail in JP-A-3-249643.

Formula (I)

$$A(L)_n\text{-}(G)_m\text{-}(Time)_t\text{-}X$$

In Formula (I), A is a redox mother nucleus or a precursor thereof, which represents an atomic group which allows $\text{-}(Time)_t\text{-}X$ to split off when the compound is oxidized during the processing of development. Time is a group which will release X after splitting off from the oxidized form of A, X is a development inhibitor, L is a divalent linking group, and G is a polarizable group. In Formula (I), each of n, m and t is 0 or 1.

The compounds represented by Formula (I) will be described below in greater detail.

The redox mother nucleus represented by A in Formula (I) is one which accords to the Kendall-Pelz law. Examples of this nucleus are hydroquinone, catechol, p-aminophenol, o-aminophenol, 1,2-naphthalenediol, 1,4-naphthalenediol, 1,6-naphthalenediol, 1,2-aminonaphthol, 1,4-aminonaphthol, 1,6-aminonaphthol, gallic ester, gallic amide, hydrazine, hydroxylamine, pyrazolidone, and reductone.

It is desirable that the amino group which these redox mother nuclei have be substituted with a sulfonyl group having 1 to 25 carbon atoms or an acyl group having 1 to 25 carbon atoms. Examples of the sulfonyl group are substituted or unsubstituted aliphatic and aromatic sulfonyl groups. Examples of the acyl group are substituted or unsubstituted aliphatic and aromatic acyl groups. The hydroxy or amino group which forms the redox mother nucleus represented by A may be protected by a protective group which enables to be deprotected at the time of development. Examples of the protective group are those having 1 to 25 carbon atoms, such as an acyl group, an alkoxycarbonyl group, a carbamoyl group, and the protective groups disclosed in JP-A-59-197037 and JP-A-59-201057. The protective group may bond to the substituent group of A, which will be described below, to form a 5-, 6-, or 7-membered ring, if possible.

The redox mother nucleus represented by A, in its substitutable position, may be substituted with a substituent group. Examples of this substituent group are those having 25 or less carbon atoms, such as an alkyl group, an aryl group, an alkylthio group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, a cyano group, a halogen atom, an acyl group, a carboxyl group, a sulfo group, a nitro group, a heterocyclic group, and $-(L)_n-(G)_m-(Time)_t-X$. These substituent groups may, in turn, be substituted with the substituent groups described above. These substituent groups may bond together, if possible, forming a saturated or unsaturated carbocyclic ring, or a saturated or unsaturated heterocyclic ring.

Preferable examples of A are hydroquinone, catechol, p-aminophenol, o-aminophenol, 1,4-naphthalenediol, 1,4-aminonaphthol, gallic ester, gallic amide, and hydrazine. Of these, hydroquinone, catechol, p-aminophenol, o-aminophenol, and hydrazine are particularly preferable. Hydroquinone and hydrazine are most preferable.

L in Formula (I) is a divalent linking group. Preferable as this group are alkylene, alkenylene, arylene, oxyalkylene, oxyarylene, aminoalkyleneoxy, aminoalkenyleneoxy, aminoaryleneoxy, and an oxygen atom.

G in Formula (I) represents an acidic group. It is preferably —CO—, —COCO—, —CS—, —SO—, SO2—, $—PO(OR^{15})—$, or $—C(=NR^{16})—$. Here, $R^{15}$ is an alkyl, aryl, or heterocyclic group, and $R^{16}$ is a hydrogen atom or of the same meaning as $R^{15}$. Of these, —CO— and —COCO— are preferable as G. The most preferable is —CO—.

In Formula (I), each of n and m is 0 or 1. Whether n and m should better be 0 or 1 depends on the type of A. Preferably, n=0, more preferably n=m=0 if A is hydroquinone, catechol, aminophenol, naphthalenediol, aminonaphythol, or the gallic derivative. Preferably, n=0, and m=1 if A is hydrazine or hydroxylamine. Preferably, n=m=1 if A is pyrazolidone.

In Formula (I), $-(Time)_t-X$ is a group which is split off, in the form of $[-(Time)_t-X]^-$, when the redox mother nucleus represented by A undergoes cross oxidation and changes into an oxidized form during the processing of development.

It is desirable that Time links to G through a sulfur atom, a nitrogen atom, an oxygen atom, or a selenium atom.

Time is a group which enables to release X after it has been released, and may have timing-adjusting function. Alternatively, it may be a coupler or a redox group which reacts with the oxidized form of a developing agent to release X.

Examples of Time which has timing-adjusting function are disclosed in, for example, U.S. Pat. Nos. 4,248,962, 4,409,323, British Patent 2,096,783, U.S Pat. No. 4,146,396, JP-A-51-146828, and JP-A-57-56837. Two or groups, selected from these, may be used in combination.

In formula (I), X represents a development inhibitor, typically the development inhibitor described in JP-A-3-249643.

X may also be a development inhibitor which is released from Time, becoming a development-inhibiting compound, which, in turn, reacts with a component of a developing solution, changing to a compound which substantially does not have, or little have, a development-inhibiting property. A functional group which undergo such chemical reaction is, for example, an ester group, a carbonyl group, an imino group, an immonium group, a Michael addition receptor group, or an imido group.

Groups which can be cited as examples of such a deactivated development inhibitor are the development inhibitor residual groups described in, for example, U.S. Pat. Nos. 4,477,563, JP-A-60-218644, JP-A-60-221750, JP-A-60-233650, and JP-A-61-11743.

Of these compounds, those having an ester group are preferred. Examples of such a compound are 1-(3-phenoxycarbonylphenyl)-5-mercaptotetrazole, 1-(4-phenoxycarbonylphenyl)-5-mercaptotetrazole, 1-(3-maleinimidophenyl)-5-mercaptotetrazole, 5-phenoxycarbonylbenzotriazole, 5-(4-cyanophenoxycarbonyl)-benzotriazole, 2-phenoxycarbonylmethylthio-5-mercapto-1,3,4-thiadiazole, 5-nitro-3-phenoxycarbonylimidazole, 5-(2,3-dichloropropyloxycarbonyl)-benzotriazole, 1-(4-benzoyloxyphenyl)-5-mercaptotetrazole, 5-(2-methanesulfonylethoxycarbonyl)-2-mercaptobenzothiazole, 5-cinnamoylaminobenzotriazole, 1-(3-vinylcarbonylphenyl)-5-mercaptotetrazole, 5-succinimidomethylbenzotriazole, 2-{4-succinimidophenyl}-5-mercapto-1,3,4-oxadiazole, 6-phenoxycarbonyl-2-mercatobenzoxazole, 2-(1-methoxycarbonylethylthio)-5-mercapto-1,3,4-thiadiazole, 2-butoxycarbonylmethoxycarbonylmethylthio-5-mercapto-1,3,4-thiadiazole, 2-(N-hexylcarbamoylmethoxycarbonylmethylthio)-5-mercapto-1,3,4-thiadiazole, and 5-butoxycarbonylmethoxycarbonylbenzotriazole.

Of the compounds represented by Formula (I), preferable are those represented by the following formulas (IA) and (IB):

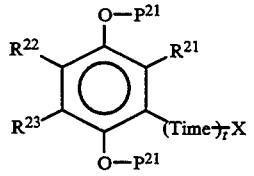

Formula (IA)

where each of $R^{21}$ to $R^{23}$ is a hydrogen atom, or a group which can be substituted on the hydroquinone nuclei, each of $p^{21}$ and $p^{22}$ is a hydrogen atom or a protective group which can be deprotected at the time of development, and Time, X, and t are of the same meaning as in Formula (I).

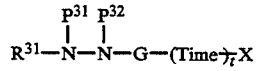

Formula (IB)

where $R^{31}$ is an aryl group, a heterocyclic group, an alkyl group, an aralkyl group, an alkenyl group, or an alkynyl group, each of $p^{31}$ and $p^{32}$ is a hydrogen atom or a protective group which can be deprotected at the time of development, and G, Time, X, and t are of the same meaning as in Formula (I).

Formula (IA) will be described in greater detail. The substituent groups represented by $R^{21}$ to $R^{23}$ can be those exemplified as substituent groups for A in the formula (I). Nonetheless, preferable as $R^{22}$ and $R^{23}$ are a hydrogen atom, an alkylthio group, an arylthio group, an alkoxy group, an aryloxy group, an amido group, a sulfonamido group, an alkoxycarbonylamino group, and a ureido group. Of these, particularly preferable are a hydrogen atom, an alkylthio group, an alkoxy group, an amido group, a sulfonamido group, an alkoxycarbonylamino group, and a ureido group. $R^{22}$ and $R^{23}$ may combine together, forming a ring.

Preferable as $R^{21}$ is a hydrogen atom, a carbamoyl group, an alkoxycarbonyl group, a sulfamoyl group, a sulfonyl group, a cyano group, an acyl group, or a heterocyclic group. Of these, particular preferable are a hydrogen atom, a carbamoyl group, an alkoxycarbonyl group, a sulfamoyl group, and a cyano group.

Examples of protective groups $p^{21}$ and $p^{22}$ may be those exemplified above as protective groups for the hydroxy group of A in Formula (I). Preferable as the protective groups are: a hydrolyzable group, such as an acyl group, an alkoxycarbonyl group, an aryloxycabonyl group, a carbamoyl group, an imidoyl group, an oxazolyl group, or a sulfonyl group; a precursor group of the type disclosed in U.S. Pat. No. 4,009,029, which utilizes reverse Mickael reaction; a precursor group of the type disclosed in U.S. Pat. No. 4,310,612, which utilizes an anion generated after ring-cleavage reaction as an intramolcular nucleophilic group; a precursor group of the type disclosed in U.S. Pat. Nos. 3,674,478, 3,932,480 and 3,993,661, which causes cleavage reaction due to the electron transfer of anions along the conjugate system; a precursor group of the type disclosed in U.S. Pat. No. 4,335,200, which causes cleavage reaction due to the electron transfer of anions which had reacted after ring-cleavage; and a precursor group of the type disclosed in U.S. Pat. Nos. 4,363,865 and 4,410,618, which utilizes an imidomethyl group.

Preferable as $p^{21}$ and $p^{22}$ are hydrogen atoms.

Preferable as X are mercaptoazoles and benzotriazoles. Particularly preferable mercaptoazoles are mercaptotetrazoles, 5-mercapto-1,3,4-thiadiazoles, and 5-mercapto-1,3,4-oxadiazoles.

The most preferable as X is a 5-mercapto-1,3,4-thiadiazole.

Of the compounds represented by Formula (IA), particularly preferred are those represented by the following formulas (IA-1) and (IA-2):

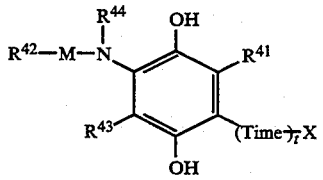

Formula (IA-1)

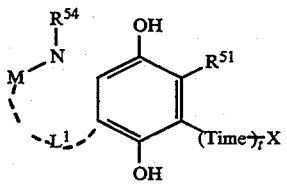

Formula (IA-2)

In Formulas (IA-1) and (IA-2), $R^{42}$ is an aliphatic group, an aromatic group or a heterocyclic group, M is —CO—, —$SO_2$—, —$(R^{45})$N—CO—, —OCO— or —$(R^{45})$N—$SO_2$—. Each of $R^{44}$, $R^{45}$, and $R^{54}$ is a hydrogen atom, an alkyl group, or an aryl group. $L^1$ is a divalent linking group required to form a 5- to 7-membered ring. $R^{41}$ and $R^{51}$ are of the same meaning as $R^{21}$ in Formula (IA), $R^{43}$ is of the same meaning as $R^{23}$ in Formula (IA), and -$(Time)_t$-X is of the same meaning as -$(Time)_t$-X in Formula (IA).

$R^{42}$ will be described in more detail. If $R^{42}$ is an aliphatic group, it is preferably a straight-chain, branched-chain or cyclic alkyl, alkenyl or alkynyl group, having 1 to 30 carbon atoms. If it is an aromatic group, it preferably has 6 to 30 carbon atoms and includes a phenyl or naphthyl group. If it is a heterocyclic group, it is preferably a 3- to 12-membered one having at least one heteroatom selected from the group consisting of nitrogen, oxygen and sulfur. Group $R^{42}$ may be substituted with any group exemplified above as substituent groups for A.

Formula (IB) will be described in more detail below.

If $R^{31}$ is an aryl group, it preferably has 6 to 20 carbon atoms and is, for example, phenyl or naphthyl. If it is a heterocyclic group, it is preferably a 5- to 7-membered one having at least one heteroatom selected from the group consisting of nitrogen, oxygen and sulfur and is, for example, furyl or pyridyl. If it is an alkyl group, it preferably has 1 to 30 carbon atoms and is, for example, methyl, hexyl, or octadecyl. If it is an aralkyl group, it preferably has 7 to 30 carbon atoms and is, for example, benzyl or trityl. If it is an alkenyl group, it preferably has 2 to 30 carbon atoms and is, for example, allyl. If it is an alkynyl group, it preferably has 2 to 30 carbon atoms and is, for example, propagyl. $R^{31}$ is preferably an aryl group, and more preferably phenyl.

Examples of the protective groups $p^{31}$ and $p^{32}$ are those which have been exemplified above as protective groups for the amino group of A in Formula (I). Preferable as $p^{31}$ and $p^{32}$ are hydrogen atoms.

Preferable as G is —CO—, and preferable as X is one which has been described in conjunction with Formula (IA).

$R^{21}$ to $R^{23}$ in Formula (IA), and $R^{31}$ in Formula (IB) may each be substituted with a substituent group. This substituent group may have a so-called ballast group which imparts anti-diffusability or a group which can be adsorbed to silver halide. A ballast group is preferred. If $R^{31}$ is a phenyl group, the substituent group is preferably an electron-donating group, such as a sulfonamido group, an amido group, an alkoxy group, or a ureido group. If $R^{21}$, $R^{22}$, $R^{23}$ or $R^{31}$ has a ballast group, it is particularly desirable that a polar group, such as a hydroxy group, a carboxyl group, or a sulfo group, exist in the molecule.

To describe the present invention more specifically, the compounds represented by the formula (I) will be specified below. However, the compounds which can be used in the invention are not limited to these.

I-1
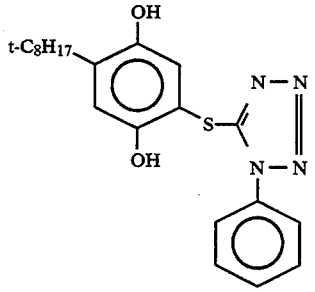
I-2
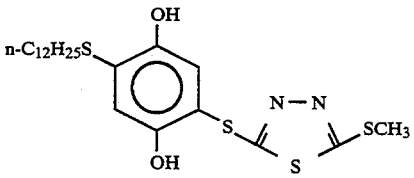
I-3
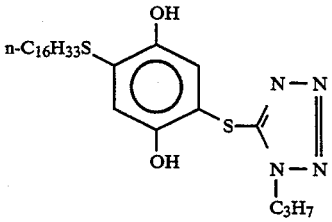
I-4
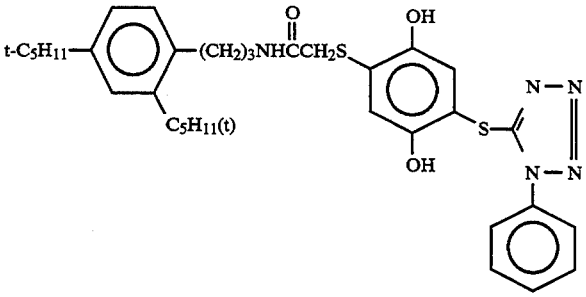
I-5
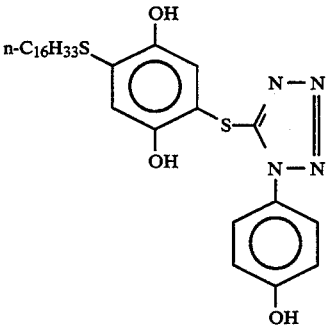
I-6
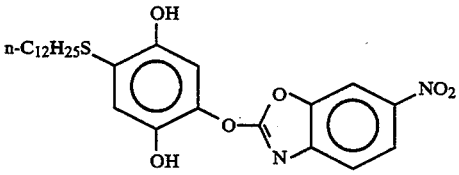
I-7
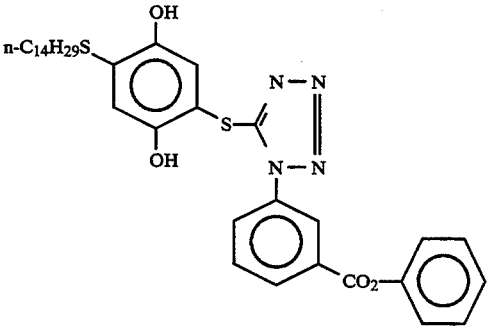
I-8
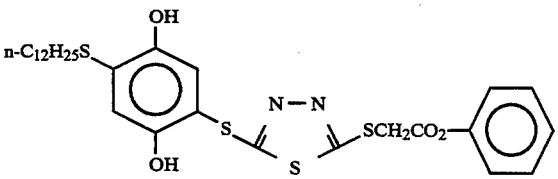

-continued
I-9
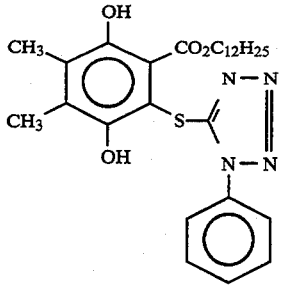
I-10
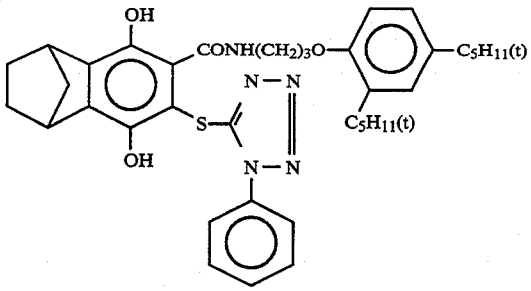
I-11
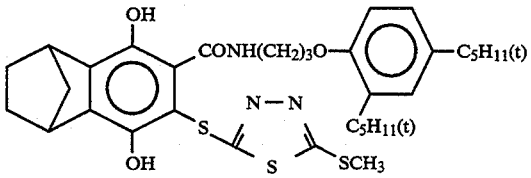
I-12
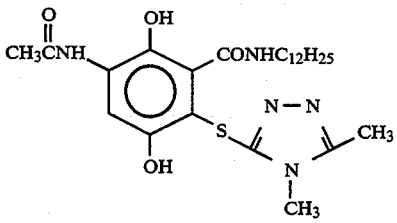
I-13
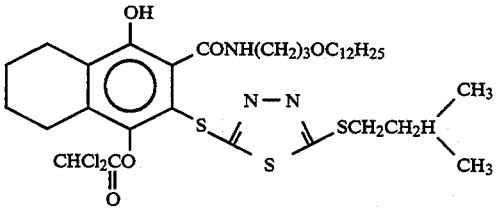
I-14
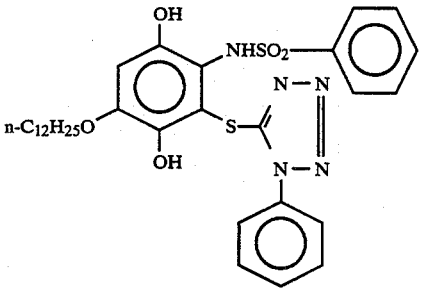
I-15
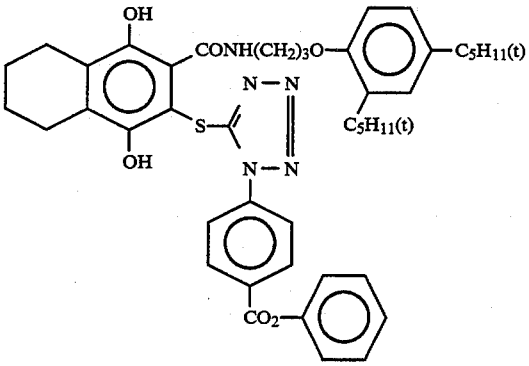
I-16
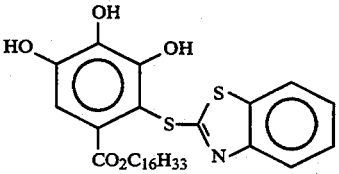
I-17
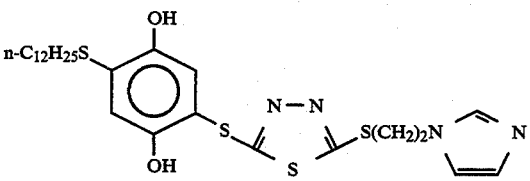
I-18
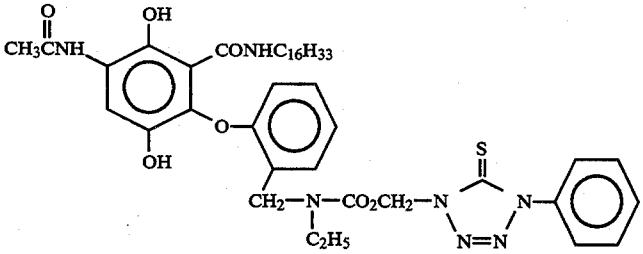

-continued
I-19
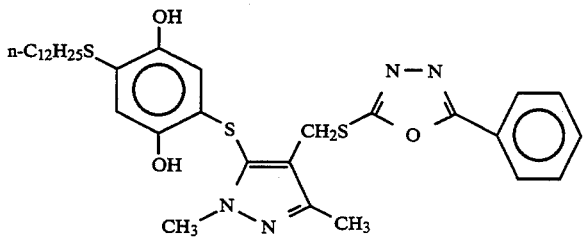
I-20
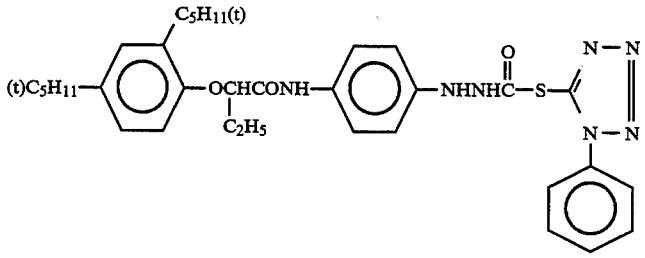
I-21
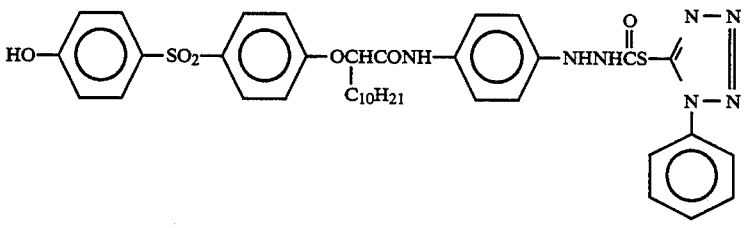
I-22
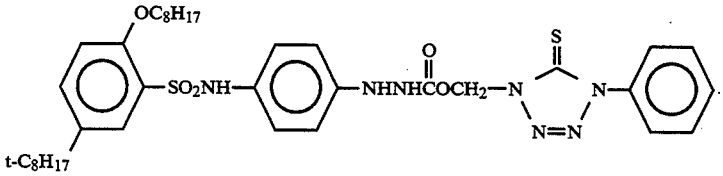
I-23
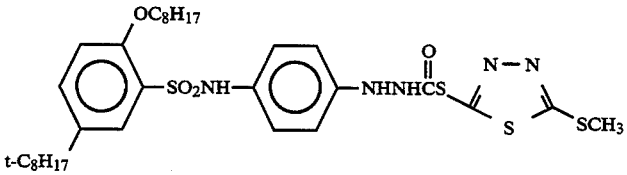
I-24
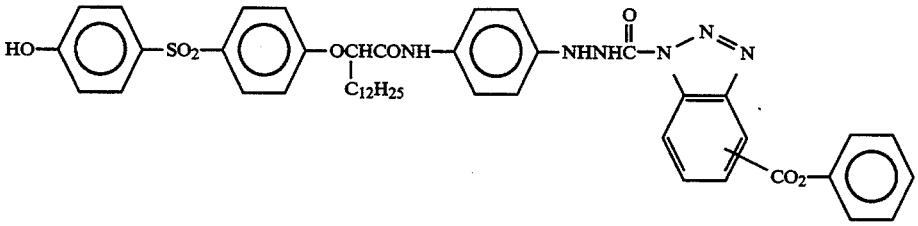
I-25
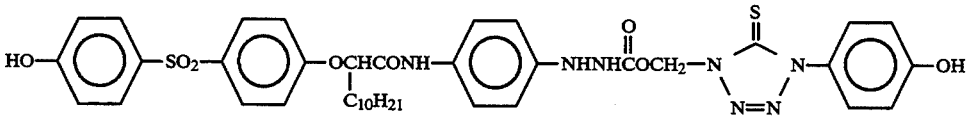
I-26
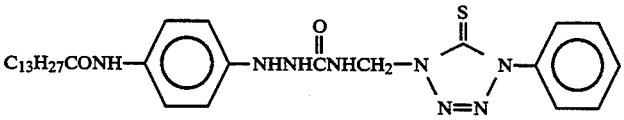

-continued
I-27
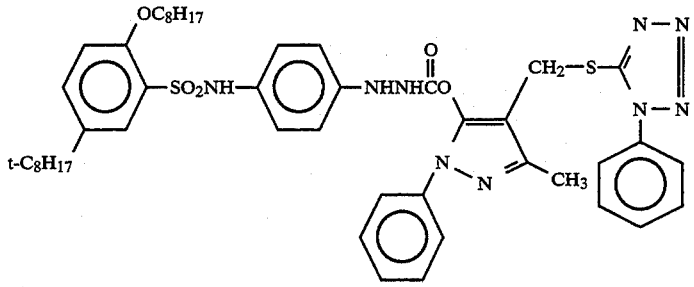
I-28
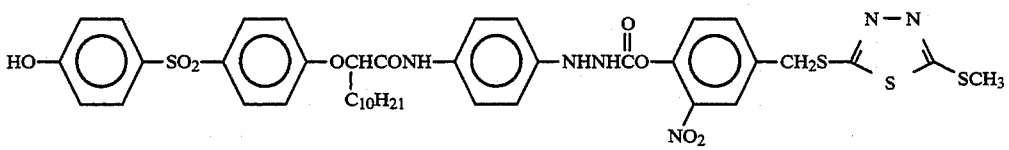
I-29
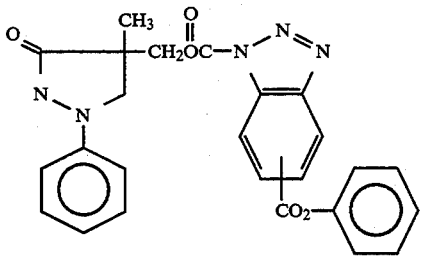
I-30
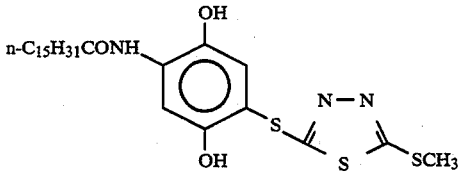
I-31
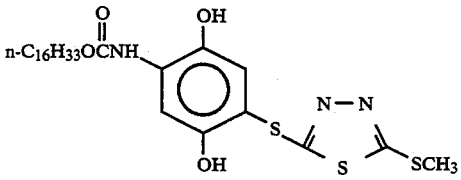
I-32
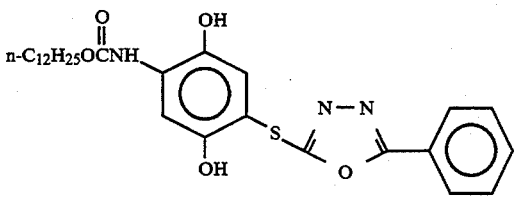
I-33
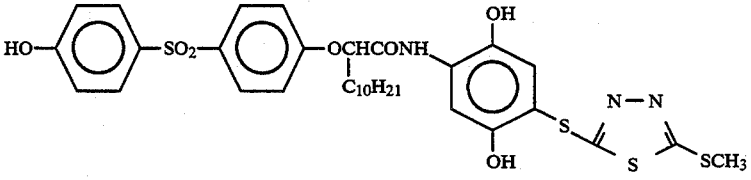
I-34
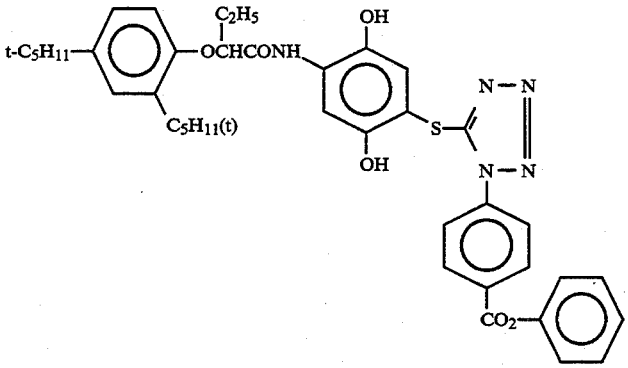
I-35
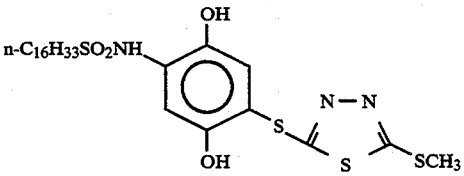
I-36
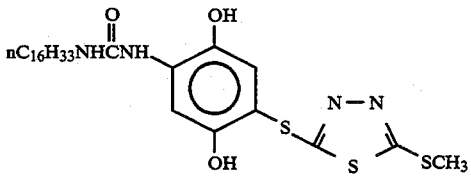

-continued
I-37
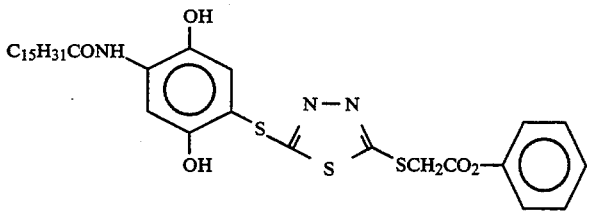
I-38
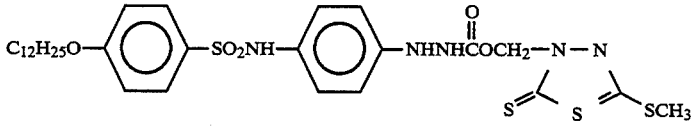
I-39
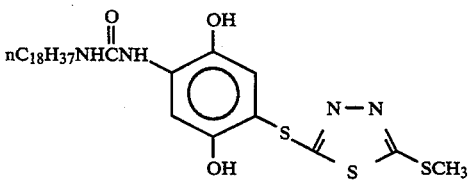
I-40
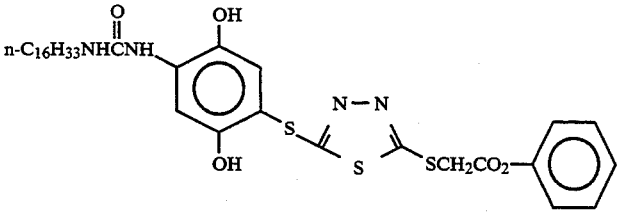
I-41
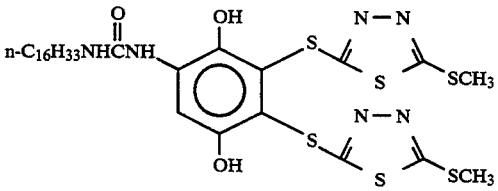
I-42
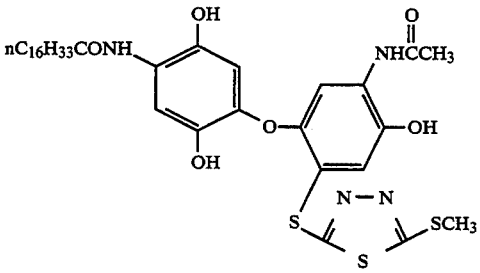
I-43
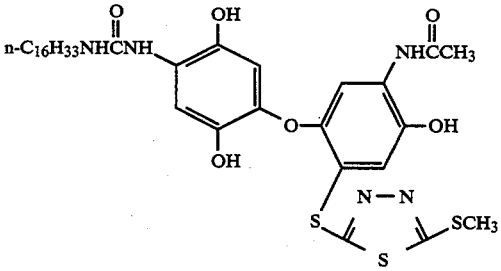
I-44
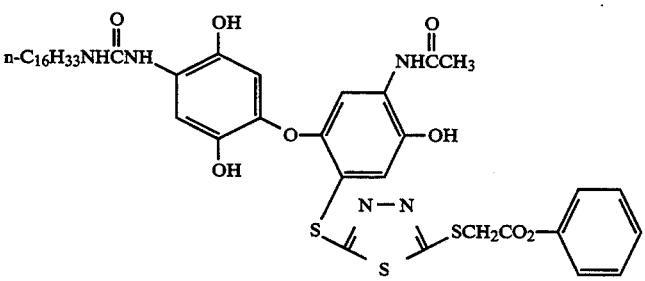

-continued

I-45

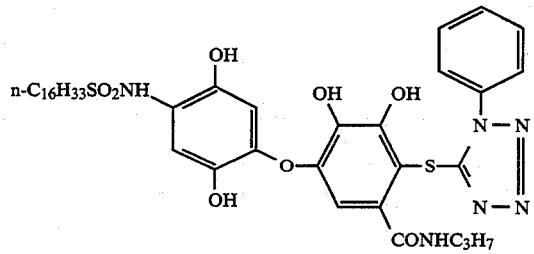

The compound represented by the formula (I) can be synthesized by the methods disclosed in JP-A-49-129536, JP-A-52-57828, JP-A-60-21044, JP-A-60-233642, JP-A-60-233648, JP-A-61-18946, JP-A-61-156043, JP-A-61-213847, JP-A-61-230135, JP-A-61-236549, JP-A-62-62352, JP-A-62-103639, U.S. Pat. Nos. 3,379,529, 3,620,746, 4,332,828, 4,377,634 and 4,684,604, JP-A-2-21127, JP-A-2-21128, and JP-A-21129.

A compound represented by Formula (I) may be added to any emulsion layer and/or any non-light-sensitive layer. The addition amount is preferably 0.001 to 0.2 mmol/m$^2$, and more preferably 0.01 to 0.1 mmol/m$^2$.

In the third aspect of the present invention, the average silver iodide content of the silver halide emulsion or grains contained in the red-sensitive silver halide emulsion layer is higher than that of the silver halide emulsion or grains contained in the green-sensitive silver halide emulsion layer. When a light-sensitive layer consists of a plurality of sublayers with different speeds, the average silver iodide content of the whole light-sensitive emulsion layer is set to equal the weighted mean of the average silver iodide contents of the individual sublayers, weighted with the silver coating amounts of these layers.

The average silver iodide content of the red-sensitive emulsion layer is higher by preferably 0.5 mol % or more, and more preferably 1.0 to 3 mol % than that of the green-sensitive emulsion layer. The average silver iodide content of the blue-sensitive emulsion layer is preferably higher by 0.5 mol % or more, usually by at most 5 mol %, than that of the green-sensitive emulsion layer.

The average silver iodide content of the red-sensitive emulsion layer is preferably 1.5 to 6.0 mol %, and more preferably 2.5 to 5.0 mol %. The average silver iodide content of the green-sensitive emulsion layer is preferably 1.0 to 4.0 mol %, and more preferably 1.5 to 3.0 mol %. The average silver iodide content of the blue-sensitive emulsion layer is preferably 1.0 to 5.5 mol %, and more preferably 2.0 to 4.5 mol %.

When a light-sensitive layer consists of a plurality of sublayers with different speeds, it is desired that sublayers with lower speeds have higher silver iodide contents. Especially when the red-sensitive layer consists of three sublayers with different speeds, it is most preferred that the silver iodide content of a red-sensitive sublayer with the lowest speed be higher by 1.0 to 5 mol % than that of a red-sensitive sublayer with the highest speed.

In the fourth aspect of the present invention, the light-sensitive material of the present invention contains a monodisperse silver halide grain emulsion with a grain diameter/grain thickness ratio of 2 to 8 in at least one light-sensitive emulsion layer. In this emulsion, silver halide grains with a diameter/thickness ratio of 2 to 8 occupy 50% or more, preferably 70% or more, and more preferably 90% or more of the projected area. The grain diameter/grain thickness ratio is preferably 3 to 7. The grain diameters and the grain thicknesses of individual grains can be obtained by observing the grains by using an electron microscope in accordance with a conventional method.

In the present invention, the monodisperse silver halide emulsion means an emulsion in which the variation ratio of grain sizes represented by (standard deviation of grain sizes)/(average grain size)$\times$100 is 20% or less, preferably 16% or less, and more preferably 13% or less.

The above monodisperse tabular silver halide emulsion can be preferably used in any emulsion layer, but it is more preferable to use the emulsion in at least one of blue-sensitive emulsion layers for the purpose of improving the color temperature dependency. The color temperature dependency was improved to unexpected levels by using the yellow coupler in the red-sensitive emulsion layer and the monodisperse tabular silver halide emulsion described above in the blue-sensitive emulsion layer. Although that was a totally unpredictable effect, the present inventors have analyzed the mechanism and estimated that the developing rate of the monodisperse tabular emulsion is adequate for selectively decreasing the interlayer effect that the red-sensitive emulsion layer has on the blue-sensitive emulsion layer, and this contributes to the above effect.

As the method of preparing the monodisperse tabular grain emulsion, for example, Examples 1 to 6 of JP-A-l-131541 can be used.

The yellow coupler with a relative coupling rate of 0.7 or more contained in the red-sensitive emulsion layer of the present invention is preferably a compound represented by Formula (II) below:

Formula (II)

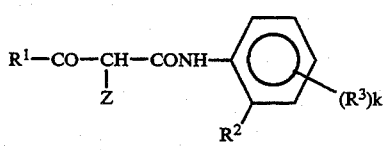

In Formula ( II ), $R^1$ represents a tertiary alkyl group, an aryl group, an $X_1(X_2)N$— group, or a group represented by $X_3N$—, $R^2$ represents a hydrogen atom, a halogen atom (F, Cl, Br, or I; the same shall apply in the following description of Formula (II)), an alkoxy group, an aryloxy group, an alkyl group, or a dialkylamino group, $R^3$ represents a group that can be substituted on the benzene ring, Z represents a hydrogen atom or a group (to be referred to as a split-off group hereinafter) that can split off through a coupling reaction with the oxidized form of an aromatic primary amine developing agent, and k represents an integer from 0 to 4. Each of $X_1$ and $X_2$ represents an alkyl group, an aryl group, or a heterocyclic group, and $X_3$ represents an organic group which forms a nitrogen-containing heterocyclic group together with >N-. Note that when k is the plural number, a plurality of $R^3$'s may be the same or different.

Examples of $R^3$ are a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an arylsulfonyl group, a ureido group, a sulfamoylamino group, an alkoxycarbonylamino group, a nitro group, a heterocyclic group, a cyano group, an acyl group, an acyloxy group, an alkylsulfonyloxy group, and an arylsulfonyloxy group. Examples of the split-off group are a heterocyclic group which bonds to a coupling active position through a nitrogen atom, an aryloxy group, an arylthio group, an acyloxy group, an alkylsulfonyloxy group, a heterocyclic oxy group, and a halogen atom. When $R^1$ is a tertiary alkyl group, this tertiary alkyl group may include a cyclic structure, such as cyclopropyl, cyclobutyl, cyclopentyl, or a cyclohexyl.

In Formula (II), it is preferred that $R^1$ be a t-butyl group, a 1-methylcyclopropyl group, a phenyl group, or a phenyl group substituted with a halogen atom, an alkyl group or an alkoxy group, $R^2$ be a halogen atom, an alkoxy group, or a phenoxy group, $R^3$ be a halogen atom, an alkoxy group, an alkoxycarbonyl group, a carbonamido group, a sulfonamido group, a carbamoyl group, or a sulfamoyl group, Z be an aryloxy group or a 5- to 7-membered heterocyclic group which bonds to a coupling active position through a nitrogen atom and may further contain N, S, 0, and/or P, and k be an integer from 0 to 2.

A coupler represented by Formula (II) may be in the form of a dimer or higher order polymer formed by linking two or more of the couplers by a divalent or higher-valent group at the substituent $R^1$, Z, or the group represented by:

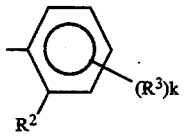

Alternatively, a coupler represented by Formula (II) may be in the form of a homopolymer, or a copolymer containing non-color-forming polymer units.

Practical examples of a coupler represented by Formula (II) are shown below. Note that yellow couplers used in Examples, which will be described later, are also within the scope of Formula (II).

II-1

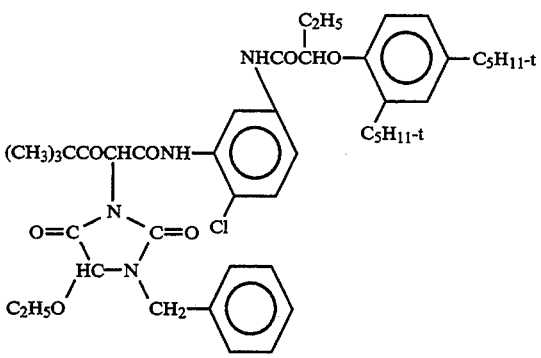

II-2

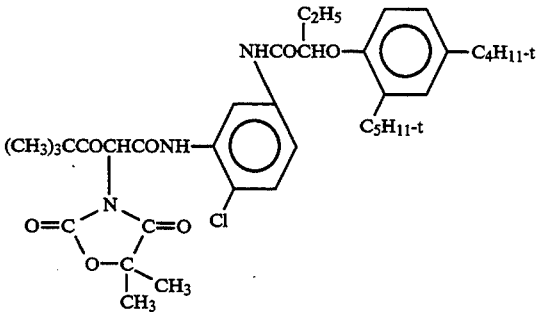

II-3

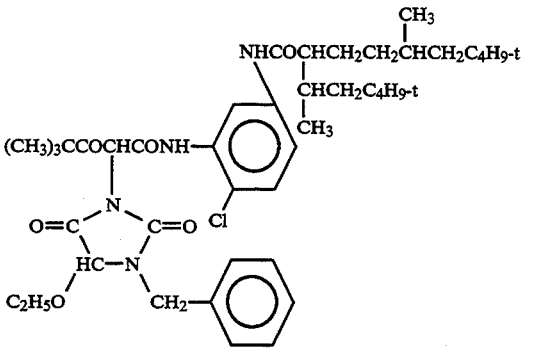

II-4

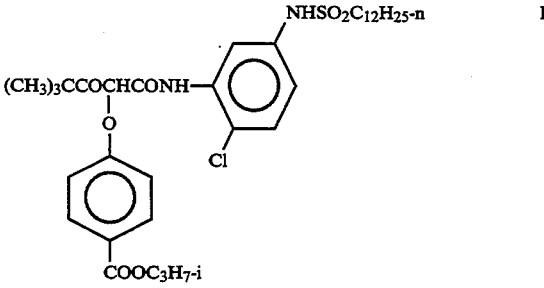

-continued
II-5
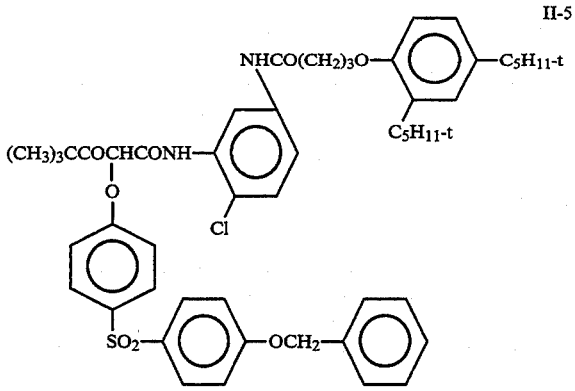
II-6
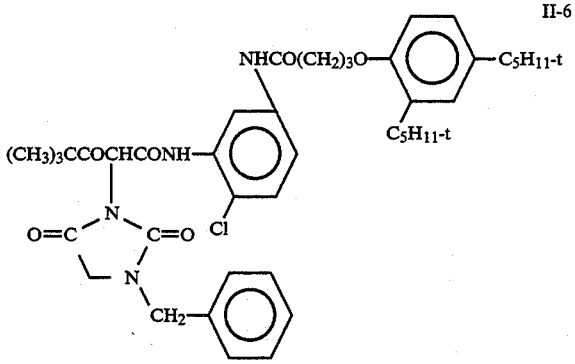
II-7
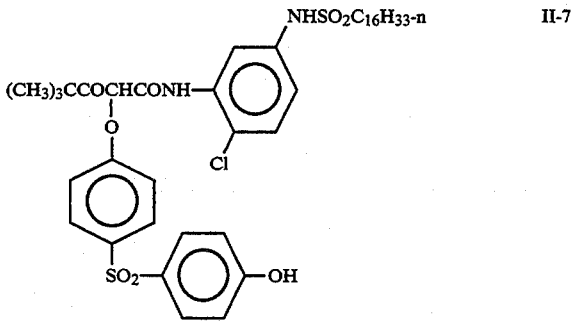
II-8
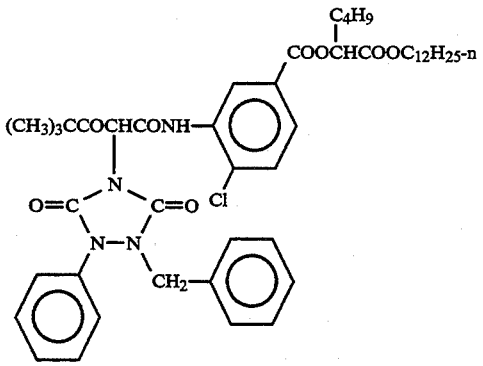
-continued
II-9
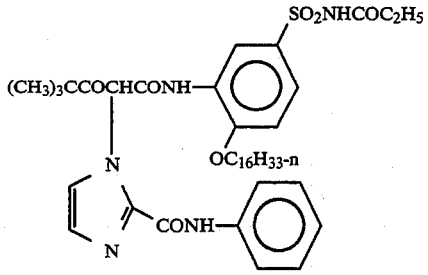
II-10
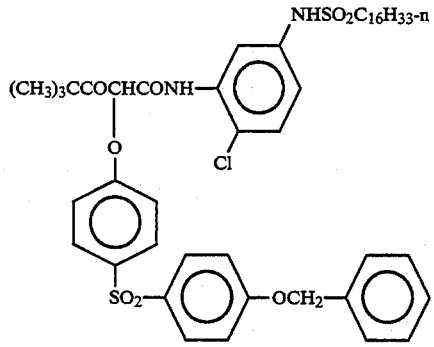
II-11
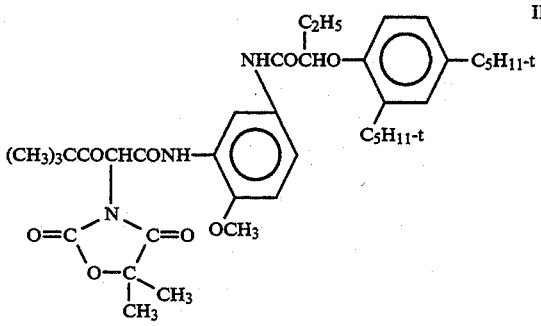
II-12
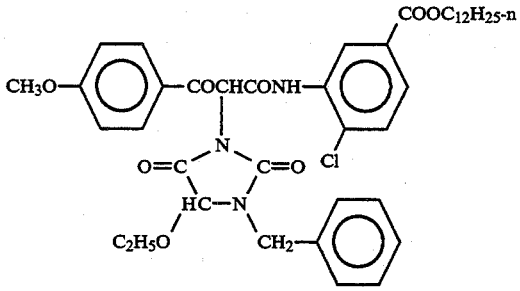
II-13
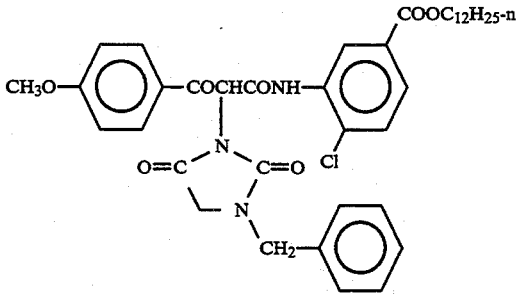

-continued
II-14
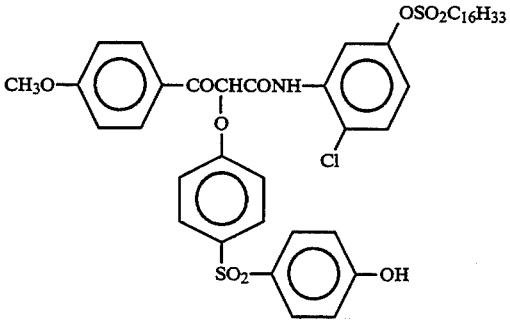
II-15
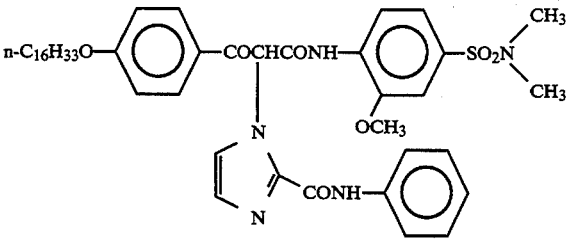
II-16
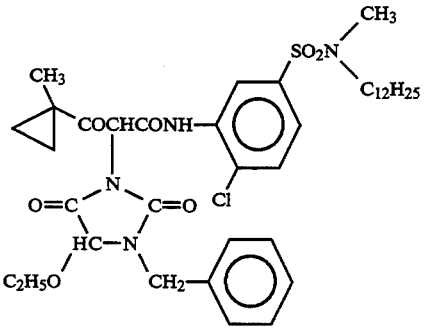
II-17
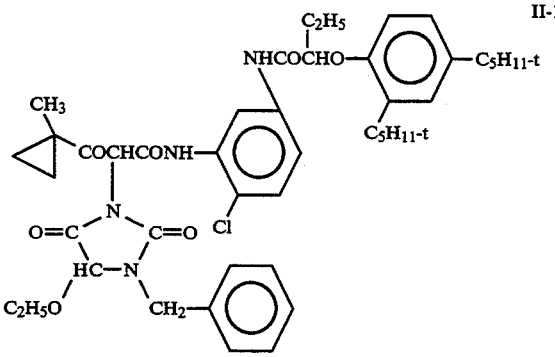
II-18
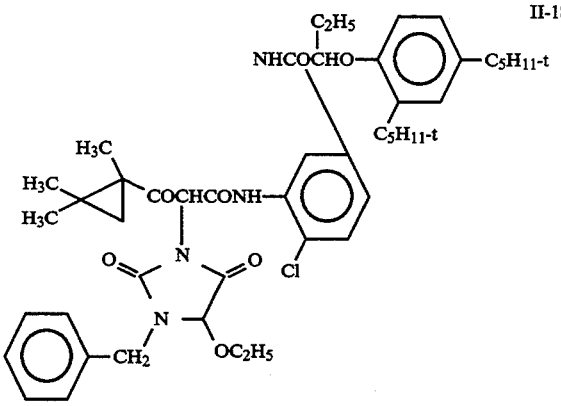
-continued
II-19
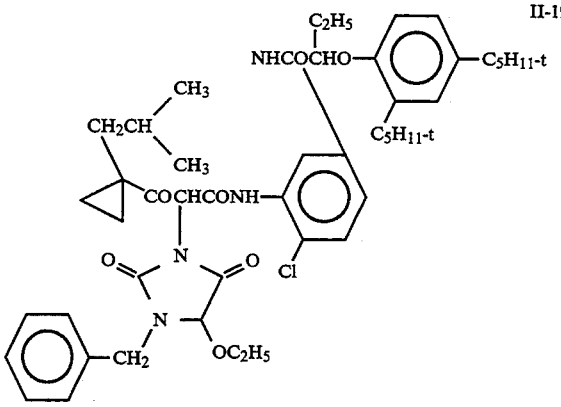
II-20
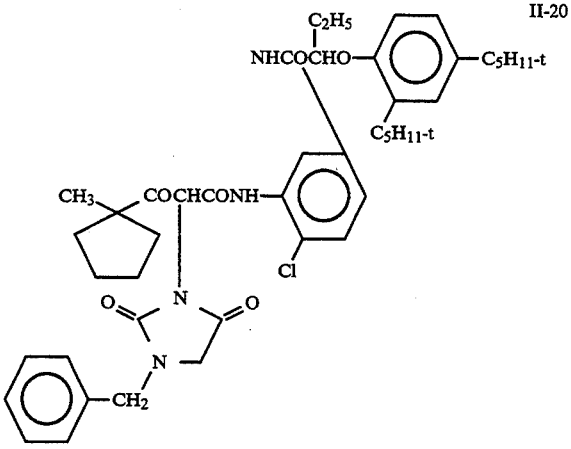
II-21
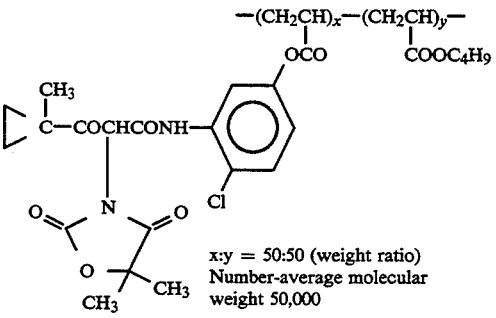
x:y = 50:50 (weight ratio)
Number-average molecular weight 50,000
II-22
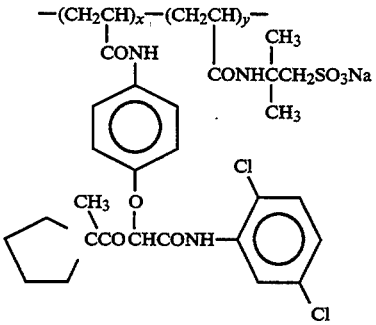
x:y = 80:20 (weight ratio)
Number-average molecular weight 70,000

-continued

II-23

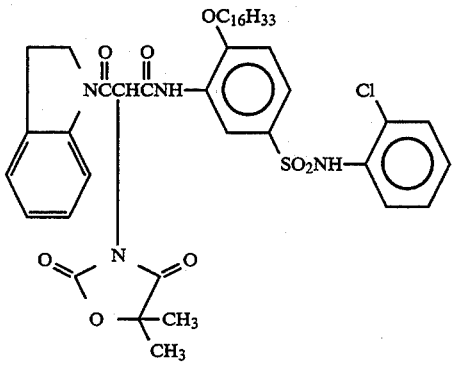

II-24

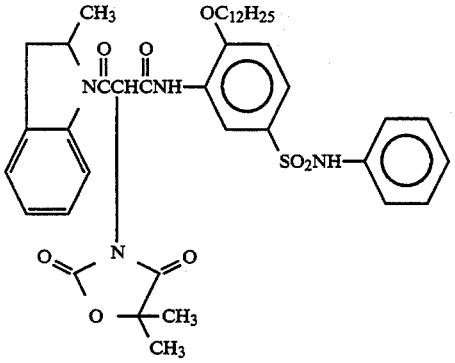

II-25

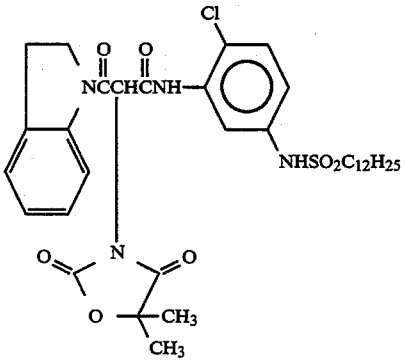

II-26

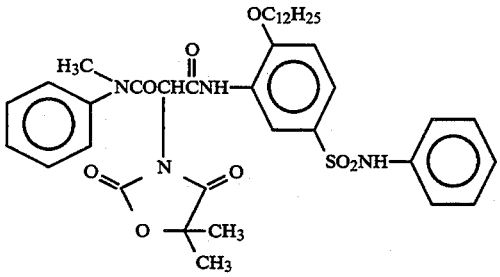

II-27

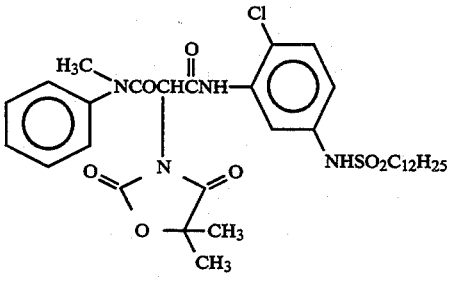

-continued

II-28

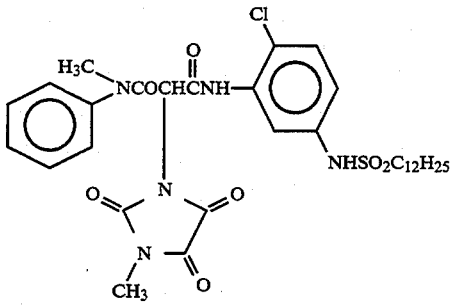

Examples of the yellow coupler which can be used in the present invention, except for those described above, and/or methods of synthesizing these yellow couplers are described in, e.g., U.S. Pat. Nos. 3,227,554, 3,408,194, 3,894,875, 3,933,501, 3,973,968, 4,022,620, 4,057,432, 4,115,121, 4,203,768, 4,248,961, 4,266,019, 4,314,023, 4,327,175, 4,401,752, 4,404,274, 4,420,556, 4,711,837, and 4,729,944, European Patents 30,747A, 284,081A, 296,793A, and 313,308A, West German Patent 3,107,173C, JP-A-58-42044, JP-A-59-174839, JP-A-62-276547, JP-A-63-123047, JP-A-4-170541, and JP-A-4-218042.

Couplers used in the present invention are not limited to the above practical examples, but those falling within the ranges of the patents described above can also be used.

A cyan coupler contained in the red-sensitive emulsion layer of the light-sensitive material of the present invention is preferably a compound represented by Formula (III) below. It is desired that a red-sensitive emulsion sublayer with the highest speed contain a cyan coupler with a higher relative coupling activity than those of cyan couplers contained in red-sensitive emulsion sublayers with lower speeds.

Formula (III)

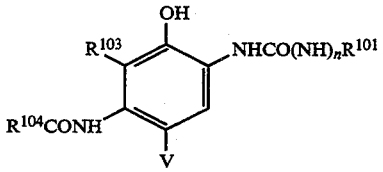

In Formula (III), $R^{101}$ represents an alkyl group, an aryl group, or a heterocyclic group, $R^{103}$ represents a hydrogen atom, a halogen atom, an alkyl group, an aryl group, an alkoxy group, an aryloxy group, a carbonamido group, or a ureido group, $R^{104}$ represents a group having the same meaning as $R^{101}$, an alkoxy group, an aryloxy group, or an amino group, v represents a hydrogen atom or a coupling split-off group, and n represents an integer of 0 or 1.

A phenol-based cyan coupler represented by Formula (III) will be described in detail below.

In Formula (III), $R^{101}$ represents a straight-chain, branched-chain, or cyclic alkyl group which has a total carbon atom number (to be referred to as a C number hereinafter) of 1 to 36 (preferably 1 to 24), may contain an unsaturated bond and may be substituted, an aryl group which has a C number of 6 to 36 (preferably 6 to 24) and may be substituted, or a heterocyclic group which has a C number of 2 to 36 (preferably 2 to 24) and may be substituted. This heterocyclic group means a 5- to 7-membered heterocyclic group which may be a condensed ring and contains at least one heteroatom selected from N, 0, S, P, Se, and Te in its ring. Examples of the heterocyclic group are 2-furyl, 2-thienyl, 4-pyridyl, 2-imidazolyl, and 4-quinolyl. Examples of the substituent of $R^{101}$ are a halogen atom, a cyano group, a nitro group, a carboxyl group, a sulfo group, an alkyl group, an aryl group, a heterocyclic group, an alkoxy group, an aryloxy group, an alkylthio group, an arylthio group, an alkylsulfonyl group, an arylsulfonyl group, an alkoxycarbonyl group, an aryloxycarbonyl group, an acyl group, a carbonamido group, a sulfonamido group, a carbamoyl group, a sulfamoyl group, a ureido group, an alkoxycarbonylamino group, and a sulfamoylamino group (these groups will collectively be referred to as a substituent group A hereinafter). The substituent is preferably a halogen atom (F, Cl, Br, or I), a cyano group, an alkyl group, an aryloxy group, an alkylsulfonyl group, an arylsulfonyl group, a carbonamido group, or a sulfonamido group. In Formula (III), $R^{101}$ is preferably an alkyl group or an aryl group.

In Formula (III), $R^{103}$ represents a hydrogen atom, a halogen atom (F, Cl, Br, or I), a straight-chain, branched-chain, or cyclic alkyl group with a C number of 1 to 16 (preferably 1 to 8), an aryl group with a C number of 6 to 24 (preferably 6 to 12), an alkoxy group with a C number of 1 to 24 (preferably 1 to 8), an aryloxy group with a C number of 6 to 24 (preferably 6 to 12), a carbonamido group with a C number of 1 to 24 (preferably 2 to 12), or a ureido group with a C number of 1 to 24 (preferably 1 to 12). If $R^{103}$ is an alkyl group, an aryl group, an alkoxy group, an aryloxy group, a carbonamido group, or a ureido group, this $R^{103}$ may be substituted with a substituent selected from the substituent group A described above. In Formula (III), $R^{103}$ is preferably a hydrogen atom, a halogen atom, an alkoxy group, or a carbonamido group, and most preferably a hydrogen atom. In Formula (III), $R^{103}$ and $R^{104}$ may bind together to form a ring. In this case, $R^{103}$ can be a constituting element of the ring as a single bond or an imino group.

In Formula (III), $R^{104}$ represents a group having the same meaning as $R^{101}$, an alkoxy group with a C number of 1 to 36 (preferably 1 to 24), an aryloxy group with a C number of 6 to 36 (preferably 6 to 24), or an alkyl- or aryl-substituted amino group with a C number of 1 to 36 (preferably 1 to 24). $R^{104}$ is preferably a group having the same meaning as $R^{101}$, and most preferably an alkyl group.

In Formula (III), V represents a hydrogen atom or a coupling split-off group which can split off through a coupling reaction with the oxidized form of an aromatic primary amine developing agent. Examples of the coupling split-off group are a halogen atom (F, Cl, Br, and I), a sulfo group, an alkoxy group with a C number of 1 to 36 (preferably 1 to 24), an aryloxy group with a C number of 6 to 36 (preferably 6 to 24), an acyloxy group with a C number of 2 to 36 (preferably 2 to 24), an alkylsulfonyloxy or arylsulfonyloxy group with a C number of 1 to 36 (preferably 1 to 24), an alkylthio group with a C number of 1 to 36 (preferably 1 to 24), an arylthio group with a C number of 6 to 36 (preferably 6 to 24), an imido group with a C number of 4 to 36 (preferably 4 to 24), a carbamoyloxy group with a C number of 1 to 36 (preferably 1 to 24), and a heterocyclic group (e.g., tetrazol-5-yl, pyrazolyl, imidazolyl, and 1,2,4-triazol-1-yl) which has a C number of 1 to 36 (preferably 2 to 24) and bonds to a coupling active position through a nitrogen atom. Of these groups, those other than a halogen atom and a sulfo group may be substituted with substituents selected from the substituent group A described above. V is preferably a hydrogen atom, a fluorine atom, a chlorine atom, a sulfo atom, an alkoxy group, or an aryloxy group, and most preferably a hydrogen atom or a chlorine atom.

In Formula (III), n represents an integer of 0 or 1, preferably 0.

Examples of the substituents in Formula (III) are presented below.

(i) Examples of $R^{101}$ are as follows.

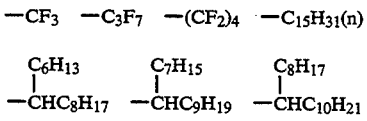

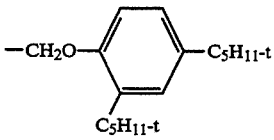

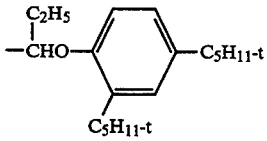

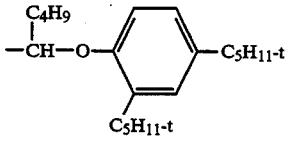

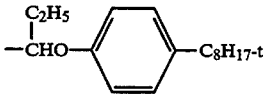

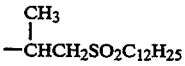

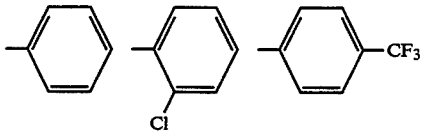

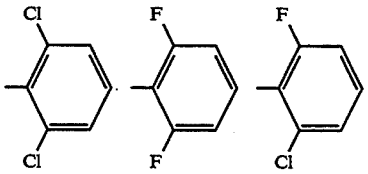

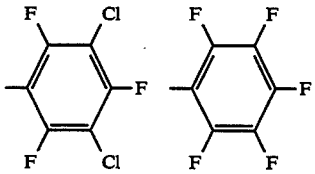

-continued
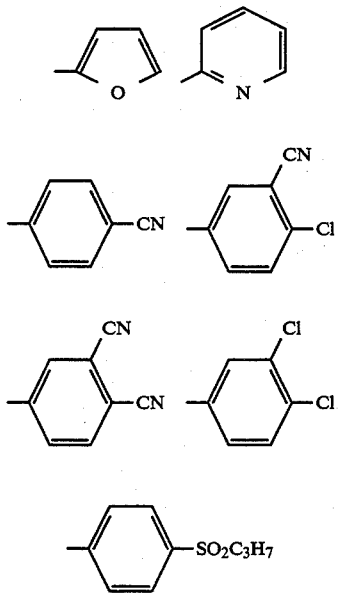
(ii) Examples of $R^{103}$ are as follows.
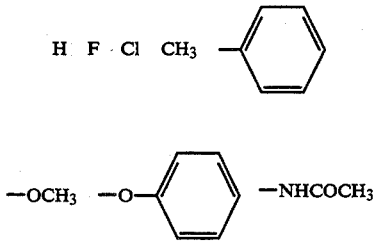
(iii) Examples of $R^{104}$ are those shown below in addition to the examples of $R^{101}$.
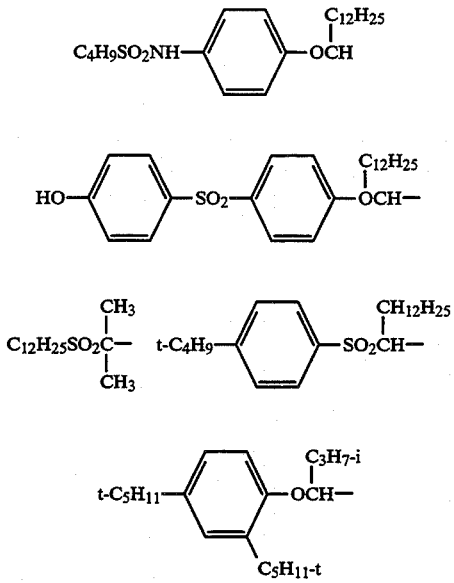
-continued
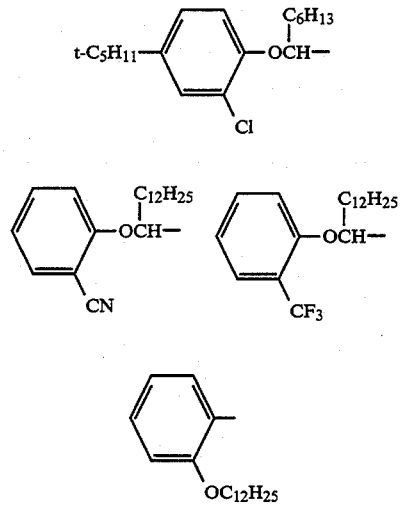
(iv) Examples of V are as follows.
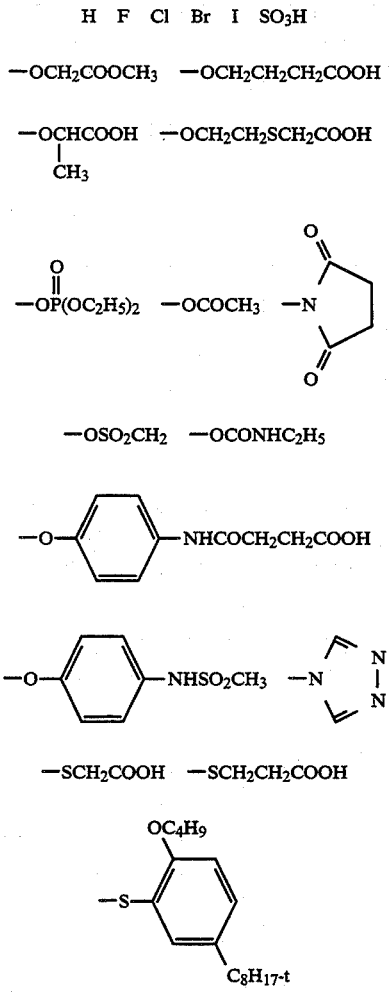
Practical examples of a cyan coupler represented by Formula (III) are presented below.

III-1
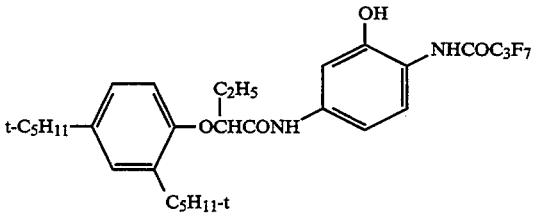
III-2
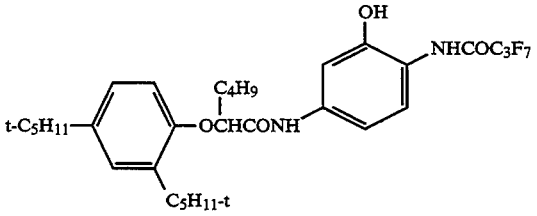
III-3
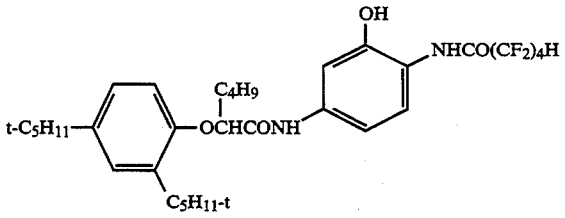
III-4
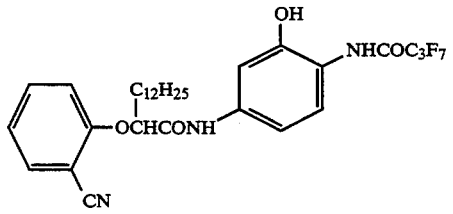
III-5
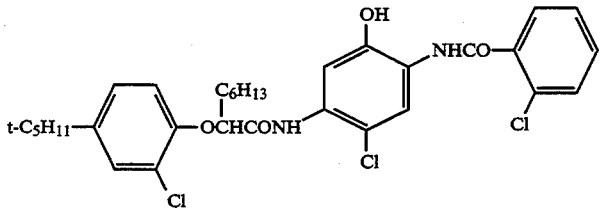
III-6
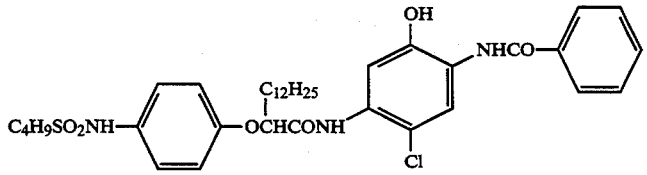
III-7
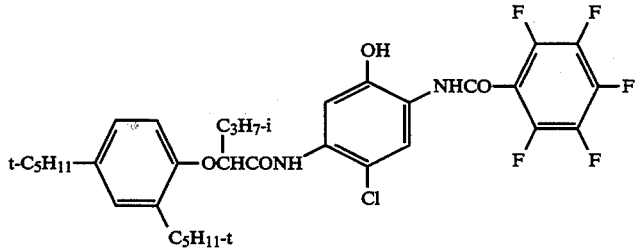

-continued
III-8
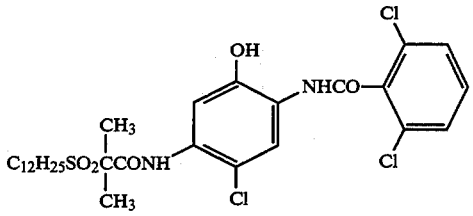
III-9
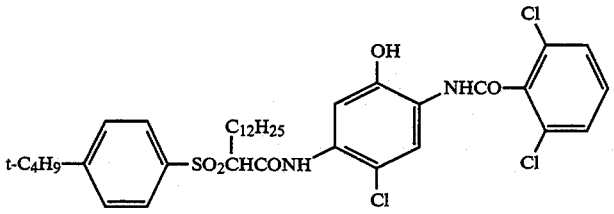
III-10
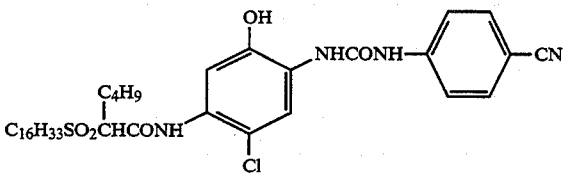
III-11
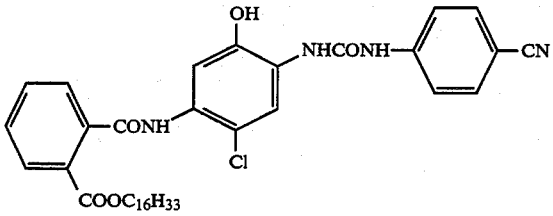
III-12
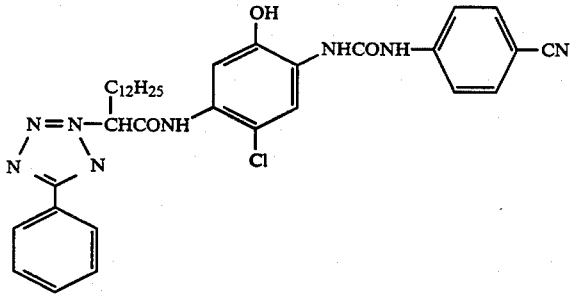
III-13
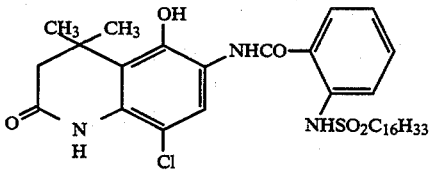
III-14
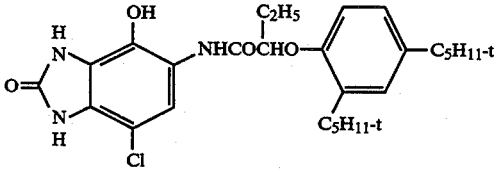

-continued

III-15

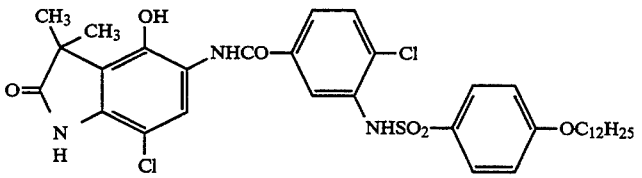

Examples of the cyan coupler other than those shown above and methods of synthesizing these cyan couplers are described in, e.g., U.S. Pat. Nos. 2,369,929, 2,772,162, 2,895,826, 3,772,002, 4,327,173, 4,333,999, 4,334,011, 4,430,423, 4,500,635, 4,518,687, 4,564,586, 4,609,619, 4,686,177, and 4,746,602, and JP-A-59-164555.

When the red-sensitive emulsion layer is constituted by a plurality of sublayers, the cyan coupler of the present invention can be added to either all of the sublayers or a specific sublayer.

The addition amount of the cyan coupler used in the present invention is 0.01 to 2 mols, preferably 0.02 to 0.5 mol per mol of silver halide.

A coupler represented by Formula (III) is preferably the one in which n=0 and $R^{101}$ is an alkyl group.

Provided that the light-sensitive material of the present invention is subject to the above-descrbied conditions, it needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

To improve the color reproduction, a donor layer (CL) of an interlayer effect can be arranged directly adjacent to, or close to, a main light-sensitive layer such as BL, GL or RL. The donor layer has a spectral sensitivity distribution which is different from that of the main light-sensitive layer. Donor layers of this type are disclosed in U.S. Pat. No. 4,663,271, U.S. Pat. No. 4,705,744, U.S. Pat. No. 4,707,436, JP-A-62-160448, and JP-A-63-89850.

As described above, various layer configurations and arrangements can be selected in accordance with the application of the light-sensitive material.

A preferable silver halide contained in photographic emulsion layers of the photographic light-sensitive material of the present invention is silver bromoiodide, silver chloroiodide, or silver chlorobromoiodide containing about 30 mol % or less of silver iodide. The most preferable silver halide is silver bromolodide or silver chlorobromoiodide containing about 2 mol % to about 10 mol % of silver iodide.

Silver halide grains contained in the photographic emulsion may have regular crystals such as cubic, octahedral, or tetradecahedral crystals, irregular crystals such as spherical, or tabular crystals, crystals having defects such as twin planes, or composite shapes thereof.

The silver halide may consist of fine grains having a grain size of about 0.2 μm or less or large grains having a projected-area diameter of up to 10 μm, and the emulsion may be either a polydisperse emulsion or a monodisperse emulsion.

The silver halide photographic emulsion which can be used in the present invention can be prepared by methods described in, for example, Research Disclosure (RD) No. 17643 (December 1978), pp. 22 to 23, "I. Emulsion preparation and types", RD No. 18716 (November 1979), page 648, and RD No. 307105 (November 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394, and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226; 4,414,310; 4,433,048 and 4,499,520, and British Patent 2,112,157.

The crystal structure may be uniform, may have different halogen compositions in the interior and the surface thereof, or may be a layered structure. Alternatively, silver halides having different compositions may be joined by an epitaxial junction, or a compound other than a silver halide such as silver rhodanide or zinc oxide may be joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/-shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in RD Nos. 17,643; 18,716 and 307,105 and they are summarized in the table represented later.

In the light-sensitive material of the present invention, two or more types of emulsions different in at least one of features such as a grain size, a grain size distribution, a halogen composition, a grain shape, and sensitivity can be mixed and used in the same layer.

Surface-fogged silver halide grains described in U.S. Pat. No. 4,082,553, internally fogged silver halide grains described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed despite the presence of a non-exposed portion and exposed portion of the light-sensitive material. A method of preparing the internally fogged or surface-fogged silver halide grain is described in U.S. Pat. No. 4,626,498 or JP-A-59-214852.

The silver halides which form the core of the internally fogged or surface-fogged core/shell silver halide grains may be of the same halogen composition or different halogen compositions. Examples of the internally fogged or surface-fogged silver halide are silver chloride, silver bromochloride, silver bromoiodide, and silver bromochloroiodide. Although the grain size of these fogged silver halide grains is not particularly limited, an average grain size is preferably 0.01 to 0.75 μm, and most preferably, 0.05 to 0.6 μm. The grain shape is also not particularly limited, and may be a regular grain shape. Although the emulsion may be a polydisperse emulsion, it is preferably a monodisperse emulsion (in which at least 95% in weight or number of silver halide grains have a grain size falling within a range of ±40% of the average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table:

| Additives | RD17643 | RD18716 | RD307105 |
|---|---|---|---|
| 1. Chemical sensitizers | page 23 | page 648, right column | page 866 |
| 2. Sensitivity-increasing | | page 648, right column | |

-continued

| Additives | RD17643 | RD18716 | RD307105 |
|---|---|---|---|
| agents | | | |
| 3. Spectral sensitizers, super-sensitizers | pp 23–24 | page 648, right column to page 649, right column | pp. 866–868 |
| 4. Brighteners | page 24 | page 648, right column | page 868 |
| 5. Antifoggants, stabilizers | pp. 24–25 | page 649, right column | pp. 868–870 |
| 6. Light absorbent, filter dye, ultra-violet absorbents | pp. 25–26 | page 649, right column to page 650, left column | page 873 |
| 7. Stain-preventing agents | page 25, right column | page 650, left-right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. No. 4,411,987 or 4,435,503, which can react with formaldehyde and fix the same, is preferably added to the light-sensitive material.

The light-sensitive material of the present invention preferably contains a mercapto compound described in U.S. Patents 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-l-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers which can be used together with the yellow coupler of Formula (II) are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler which can be used together with the cyan coupler of Formula (III) are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, west German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD No. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

RD Nos. 11449 and 24241, and JP-A-61-201247, for example, disclose couplers which release bleaching accelerator. These couplers effectively serve to shorten the time of any process that involves bleaching. They are effective, particularly when added to light-sensitive material containing tabular silver halide grains. Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat.

No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glycerol-tributyrate, isostearyllactate, and trioctylcitrate), an aniline derivative (e.g., N,N-dibutyl-2-butoxy-5-tertoctylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and a color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 seconds or less, and more preferably, 20 seconds or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swello-meter described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{\frac{1}{2}}$ is defined as a time required for reaching 1/2 of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness − film thickness)/film thickness.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides and p-toluenesulfonates thereof. Of these compounds, 3-methyl-4-amino-N-ethyl-N-β-hydroxyethylaniline, and the sulfate thereof are preferred in particular. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof. The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

$$Aperture = [contact\ area\ (cm^2)\ of\ processing\ solution\ with\ air]/[volume\ (cm^3)\ of\ the\ solution]$$

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds descried in West German Patents 966,410 and 2,748,430; polyamine compounds described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, west German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. Further, in order to stabilize the fixing solution or the bleach-fixing solution, various types of aminopolycarboxylic acids or organic phosphonic acids are preferably added to the solution.

In the present invention, 0.1 to 10 moles, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite. Various chelating agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used.

Examples of the precursor are an indoaniline-based compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

Further, the silver halide light-sensitive material of the present invention can be applied also to a heat-developing light-sensitive material as disclosed in, e.g., U.S. Pat. No. 4,500,626, JP-A-60-133449, JP-A-59-218443, JP-A-61-238056, and European Patent 210,660A2.

The present invention will be described in more detail below by way of its examples, but the invention is not limited to these examples.

EXAMPLE 1

Making of Sample 101

A multilayered color light-sensitive material consisting of layers having the following compositions was formed on a subbed 127-fm thick cellulose triacetate film support, thereby making a sample 101. The numbers represent addition amounts per $m^2$. The effect of each compound added is not limited to the one described.

| | |
|---|---|
| 1st layer: Antihalation layer | |
| Black colloidal silver | silver 0.20 g |
| Gelatin | 1.9 g |
| Ultraviolet absorbent U-1 | 0.1 g |
| Ultraviolet absorbent U-3 | 0.04 g |
| Ultraviolet absorbent U-4 | 0.1 g |
| High-boiling organic solvent Oil-1 | 0.1 g |
| Microcrystalline solid dispersion of dye E-1 | 0.1 g |
| 2nd layer: Interlayer | |
| Gelatin | 0.04 g |
| Compound Cpd-C | 5 mg |
| Compound Cpd-J | 5 mg |
| Compound Cpd-K | 3 mg |
| High-boiling organic solvent Oil-3 | 0.1 g |
| Dye D-4 | 0.8 mg |
| 3rd layer: Interlayer | |
| Surface-fogged and internally fogged fine grain silver bromoiodide emulsion (average grain size: 0.06 μm, variation coefficient: 18%, AgI content: 1 mol %) | silver 0.05 g |
| Gelatin | 0.4 g |
| 4th layer: | |
| Low-speed red-sensitive emulsion layer | |
| Emulsion A | silver 0.3 g |
| Emulsion B | silver 0.2 g |
| Gelatin | 0.8 g |
| Coupler C-1 (cyan coupler) | 0.12 g |
| Coupler C-2 (cyan coupler) | 0.05 g |
| Coupler C-6 (yellow coupler) | 0.0036 g |
| Compound Cpd-C | 5 mg |
| High-boiling organic solvent Oil-2 | 0.1 g |

-continued

| | |
|---|---|
| Additive P-1 | 0.1 g |
| 5th layer: | |
| Medium-speed red-sensitive emulsion layer | |
| Emulsion C | silver 0.5 g |
| Gelatin | 0.8 g |
| Coupler C-1 (cyan coupler) | 0.12 g |
| Coupler C-2 (cyan coupler) | 0.05 g |
| Coupler C-6 (yellow coupler) | 0.011 g |
| High-boiling organic solvent Oil-2 | 0.1 g |
| Additive P-1 | 0.1 g |
| 6th layer: | |
| High-speed red-sensitive emulsion layer | |
| Emulsion D | silver 0.4 g |
| Gelatin | 1.1 g |
| Coupler C-3 (cyan coupler) | 0.65 g |
| Coupler C-6 (yellow coupler) | 0.054 g |
| Additive P-1 | 0.1 g |
| 7th layer: Interlayer | |
| Gelatin | 0.6 g |
| Additive M-1 | 0.3 g |
| Color mixing inhibitor Cpd-I | 2.6 mg |
| Dye D-5 | 0.02 g |
| High-boiling organic solvent Oil-1 | 0.02 g |
| 8th layer: Interlayer | |
| Surface-fogged and internally fogged silver bromoiodide emulsion (average grain size: 0.06 μm, variation coefficient: 16%, AgI content: 0.3 mol %) | silver 0.02 g |
| Gelatin | 1.0 g |
| Additive P-1 | 0.2 g |
| Color mixing inhibitor Cpd-A | 0.1 g |
| Compound Cpd-C | 0.1 9 |
| 9th layer: | |
| Low-speed green-sensitive emulsion layer | |
| Emulsion E | silver 0.1 g |
| Emulsion F | silver 0.2 g |
| Emulsion G | silver 0.2 g |
| Gelatin | 0.5 g |
| Coupler C-4 (magenta coupler) | 0.1 g |
| Coupler C-7 (magenta coupler) | 0.05 g |
| Coupler C-8 (magenta coupler) | 0.20 g |
| Compound Cpd-B | 0.03 g |
| Compound Cpd-D | 0.02 g |
| Compound Cpd-E | 0.02 g |
| Compound Cpd-F | 0.04 g |
| Compound Cpd-L | 0.02 g |
| High-boiling organic solvent Oil-1 | 0.1 g |
| High-boiling organic solvent Oil-2 | 0.1 g |
| 10th layer: | |
| Medium-speed green-sensitive emulsion layer | |
| Emulsion H | silver 0.4 g |
| Gelatin | 0.6 g |
| Coupler C-4 (magenta coupler) | 0.1 g |
| Coupler C-7 (magenta coupler) | 0.2 g |
| Coupler C-8 (magenta coupler) | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-L | 0.05 g |
| High-boiling organic solvent Oil-2 | 0.01 g |
| 11th layer: | |
| High-speed green-sensitive emulsion layer | |
| Emulsion I | silver 0.5 g |
| Gelatin | 1.0 g |
| Coupler C-4 (magenta coupler) | 0.3 g |
| Coupler C-7 (magenta coupler) | 0.1 g |
| Coupler C-8 (magenta coupler) | 0.1 g |
| Compound Cpd-B | 0.08 g |
| Compound Cpd-E | 0.02 g |
| Compound Cpd-F | 0.04 g |
| Compound Cpd-K | 5 mg |
| Compound Cpd-L | 0.02 g |
| High-boiling organic solvent Oil-1 | 0.02 g |
| High-boiling organic solvent Oil-2 | 0.02 g |
| 12th layer: Interlayer | |
| Gelatin | 0.6 g |
| Compound Cpd-L | 0.05 g |
| High-boiling organic solvent Oil-1 | 0.05 g |
| 13th layer: Yellow filter layer | |

-continued

| | |
|---|---|
| Yellow colloidal silver | silver 0.07 g |
| Gelatin | 1.1 g |
| Color mixing inhibitor Cpd-A | 0.01 g |
| Compound Cpd-L | 0.01 g |
| High-boiling organic solvent Oil-1 | 0.01 g |
| Microcrystalline solid dispersion of dye E-2 | 0.05 g |
| 14th layer: Interlayer | |
| Gelatin | 0.6 g |
| 15th layer: | |
| Low-speed blue-sensitive emulsion layer | |
| Emulsion J | silver 0.5 g |
| Gelatin | 0.8 g |
| Coupler C-5 (yellow coupler) | 0.2 g |
| Coupler C-6 (yellow coupler) | 0.1 g |
| Coupler C-10 (yellow coupler) | 0.4 g |
| 16th layer: | |
| Medium-speed blue-sensitive emulsion layer | |
| Emulsion L | silver 0.5 g |
| Gelatin | 0.9 g |
| Coupler C-5 (yellow coupler) | 0.1 g |
| Coupler C-6 (yellow coupler) | 0.1 g |
| Coupler C-10 (yellow coupler) | 0.6 g |
| 17th layer: | |
| High-speed blue-sensitive emulsion layer | |
| Emulsion M | silver 0.2 g |
| Emulsion N | silver 0.2 g |
| Gelatin | 1.2 g |
| Coupler C-5 (yellow coupler) | 0.1 g |
| Coupler C-6 (yellow coupler) | 0.1 g |
| Coupler C-10 (yellow coupler) | 0.6 g |
| High-boiling organic solvent Oil-2 | 0.1 g |
| 18th layer: 1st protective layer | |
| Gelatin | 0.7 g |
| Ultraviolet absorbent U-1 | 0.2 g |
| Ultraviolet absorbent U-2 | 0.05 g |
| Ultraviolet absorbent U-5 | 0.3 g |
| Formalin scavenger Cpd-H | 0.4 g |
| Dye D-1 | 0.15 g |
| Dye D-2 | 0.05 g |
| Dye D-3 | 0.1 g |
| 19th layer: 2nd protective layer | |
| Colloidal silver | silver 0.1 mg |
| Fine grain silver bromoiodide emulsion (average grain size: 0.06 μm, AgI content 1 mol %) | silver 0.1 mg |
| Gelatin | 0.4 g |
| 20th layer: 3rd protective layer | |
| Gelatin | 0.4 g |
| Polymethylmethacrylate (average grain size 1.5 μm) | 0.1 g |
| 4:6 copolymer of methylmethacrylate and acrylic acid (average grain size 1.5 μm) | 0.1 g |
| Silicone oil | 0.03 g |

-continued

| | |
|---|---|
| Surfactant W-1 | 3.0 mg |
| Surfactant W-2 | 0.03 g |

In addition to the above compositions, all of the emulsion layers were added with additives F-1 to F-8. In addition, the individual layers were added with a gelatin hardener H-1 and surfactants W-3, W-4, W-5, and W-6 for coating and emulsification, in addition to the above substances.

Furthermore, the sample was also added with phenol, 1,2-benzisothiazolin-3-one, 2-phenoxyethanol, phenethyl alcohol, and p-butyl benzoate as antiseptic and mildewproofing agents.

The silver bromoiodide emulsions A to N used in the sample 101 are listed in Table 1 below, and the spectral sensitization performed for each emulsion is shown in Tables 2 and 3 below.

TABLE 1

| Emulsion name | Characteristics of grains | Equivalent-sphere average grain size (μm) | Variation coefficient (%) | AgI content (%) |
|---|---|---|---|---|
| A | Monodisperse tetradecahedral grain | 0.28 | 16 | 4.5 |
| B | Monodisperse cubic internal latent image type grain | 0.30 | 10 | 4.5 |
| C | Monodisperse cubic grain | 0.38 | 10 | 4.0 |
| D | Tabular grain, average aspect ratio 3.0 | 0.68 | 25 | 2.5 |
| E | Monodisperse cubic grain | 0.20 | 17 | 3.2 |
| F | Monodisperse tetradecahedral grain | 0.23 | 16 | 3.2 |
| G | Monodisperse cubic internal latent image type grain | 0.28 | 11 | 3.2 |
| H | Monodisperse cubic grain | 0.32 | 9 | 3.0 |
| I | Tabular grain, average aspect ratio 5.0 | 0.80 | 30 | 2.0 |
| J | Monodisperse tabular grain | 0.30 | 16 | 4.0 |
| L | Tabular grain, average aspect ratio 4.2 | 0.55 | 14 | 2.0 |
| M | Tabular grain, average aspect ratio 6.0 | 1.00 | 28 | 1.5 |
| N | Tabular grain, average aspect ratio 9.0 | 1.20 | 26 | 1.5 |

TABLE 2

Spectral sensitization of emulsions A to I

| Emulsion name | Sensitizing dyes added | Addition amount (g) per mol of silver halide |
|---|---|---|
| A | S-2 | 0.025 |
| | S-3 | 0.25 |
| | S-8 | 0.01 |
| B | S-1 | 0.01 |
| | S-3 | 0.25 |
| | S-8 | 0.01 |
| C | S-1 | 0.01 |
| | S-2 | 0.01 |
| | S-3 | 0.25 |
| | S-8 | 0.01 |
| D | S-2 | 0.01 |
| | S-3 | 0.10 |
| | S-8 | 0.01 |
| E | S-4 | 0.5 |
| | S-5 | 0.1 |
| F | S-4 | 0.3 |
| | S-5 | 0.1 |
| G | S-4 | 0.25 |
| | S-5 | 0.08 |
| | S-9 | 0.05 |
| H | S-4 | 0.2 |
| | S-5 | 0.06 |
| | S-9 | 0.05 |
| I | S-4 | 0.3 |
| | S-5 | 0.07 |

TABLE 2-continued
Spectral sensitization of emulsions A to I
| Emulsion name | Sensitizing dyes added | Addition amount (g) per mol of silver halide |
|---|---|---|
| | S-9 | 0.1 |
TABLE 3
Spectral sensitization of emulsions J to N
| Emulsion name | Sensitizing dyes added | Addition amount (g) per mol of silver halide |
|---|---|---|
| J | S-6 | 0.05 |
| | S-7 | 0.2 |
| L | S-6 | 0.06 |
| | S-7 | 0.22 |
| M | S-6 | 0.04 |
| | S-7 | 0.15 |
| N | S-6 | 0.06 |
| | S-7 | 0.22 |
C-1
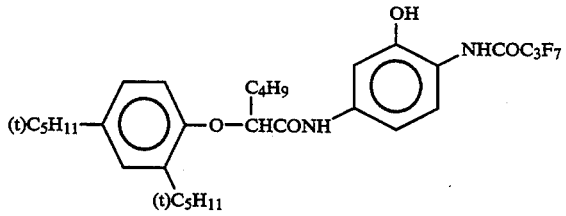
C-2
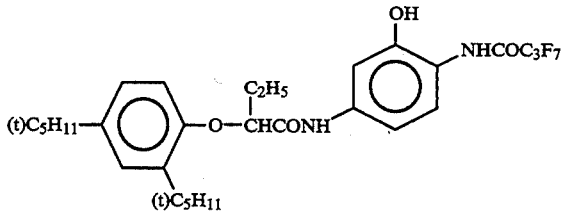
C-3
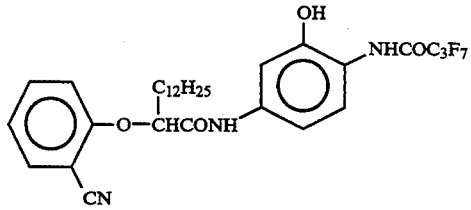
C-4
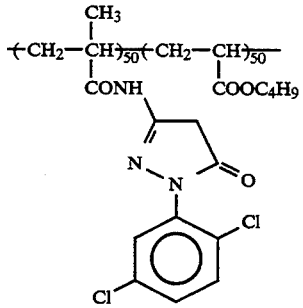
Number represents wt %
Average molecular weight: about 25,000

-continued
C-5
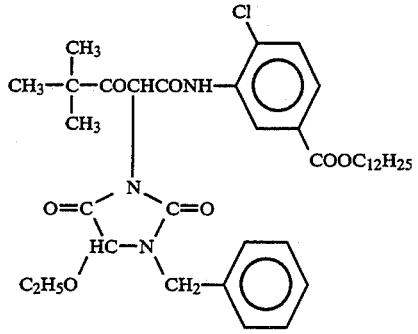
C-6
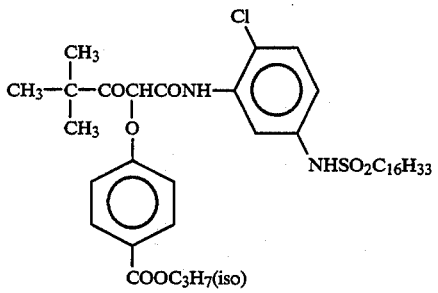
C-7
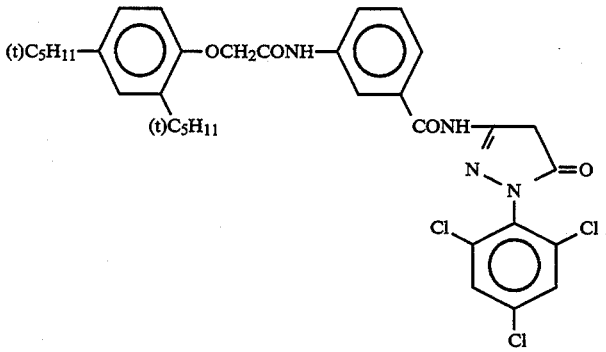
C-8
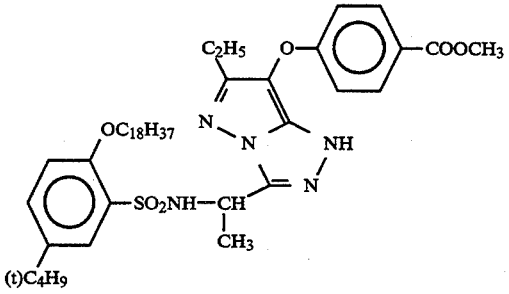
C-10
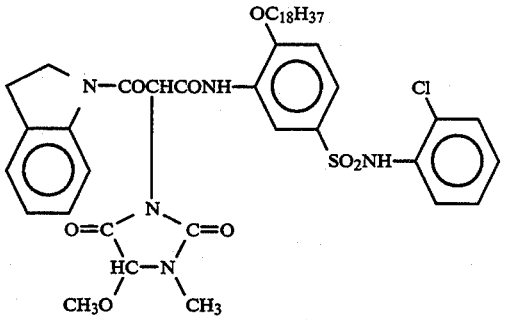
Dibuty phthalate Oil-1
Tricresyl phosphate Oil-2

-continued
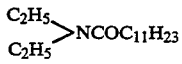
Oil-3
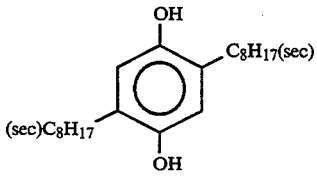
Cpd-A
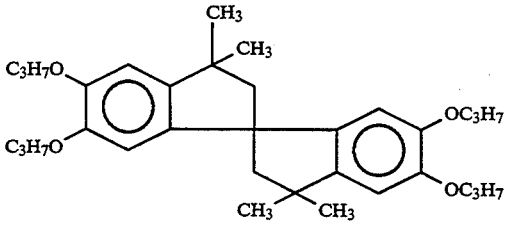
Cpd-B
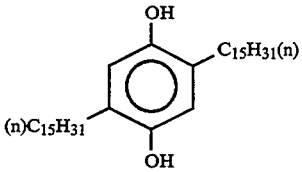
Cpd-C
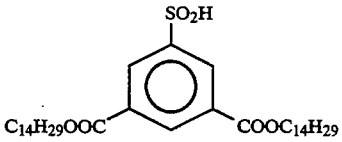
Cpd-D
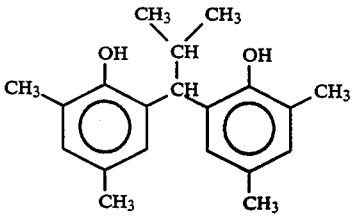
Cpd-E
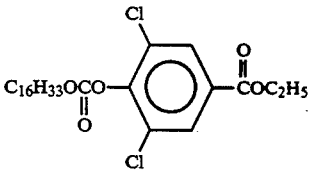
Cpd-F
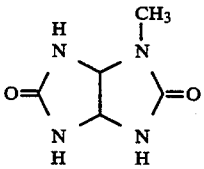
Cpd-H
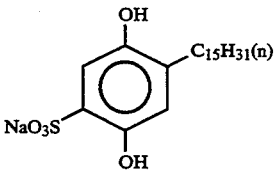
Cpd-I -continued
Cpd-J
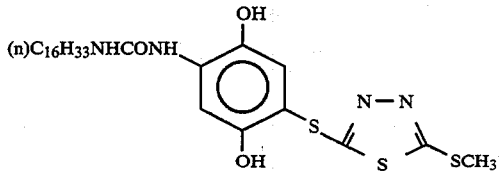
Cpd-K
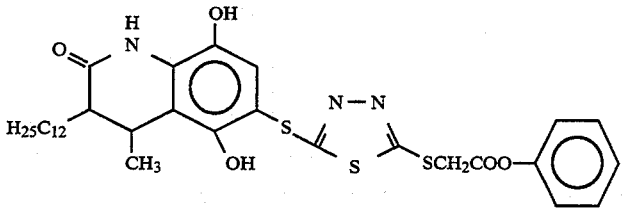
Cpd-L
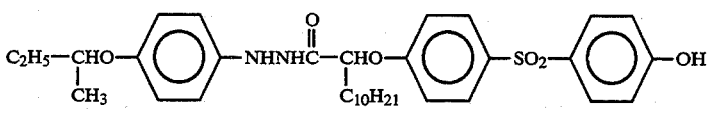
U-1
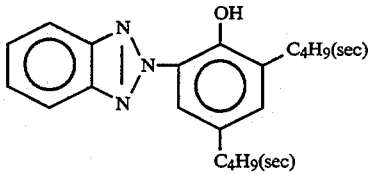
U-2
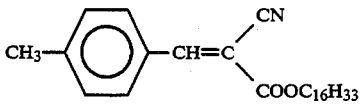
U-3
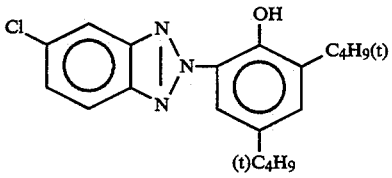
U-4
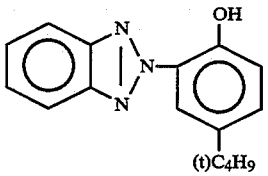
U-5
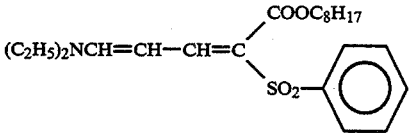
S-1
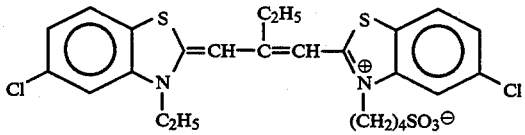
S-1
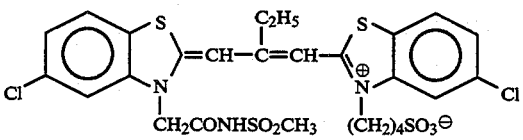

-continued
S-3
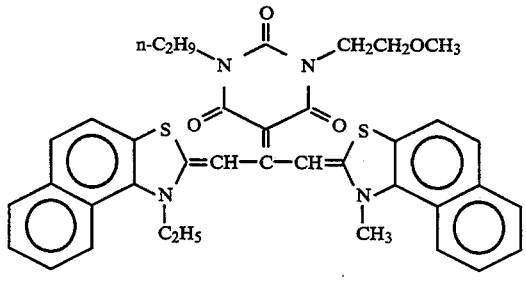
S-4
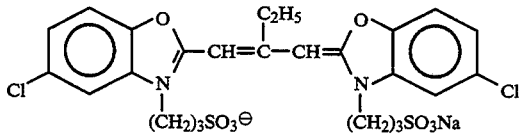
S-5
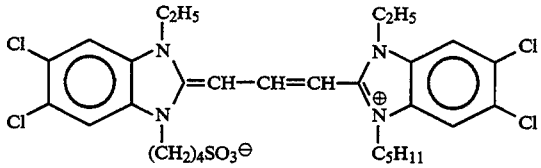
S-6
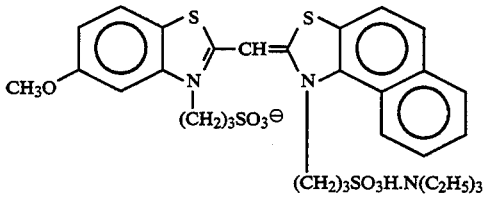
S-7
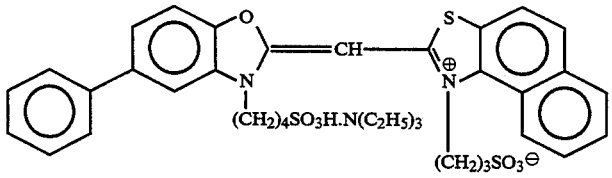
S-8
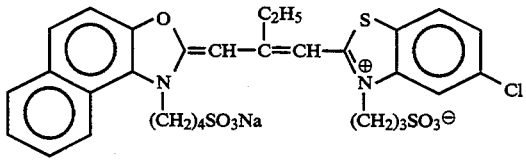
S-9
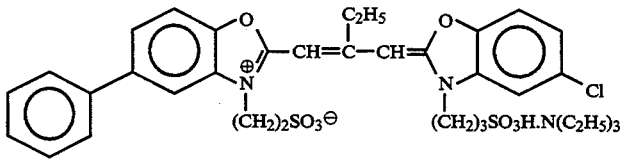
D-1
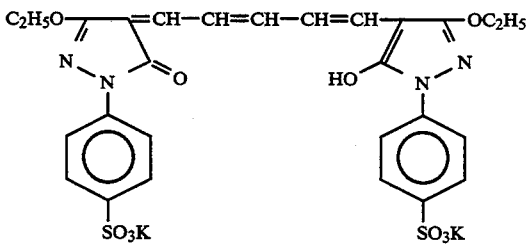

-continued
D-2
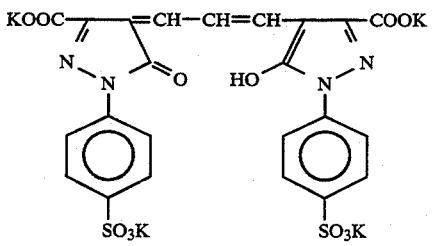
D-3
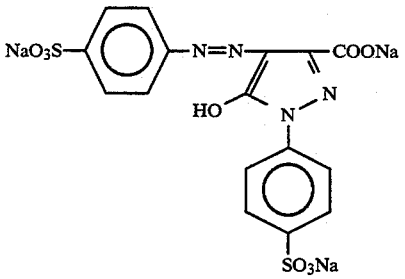
D-4
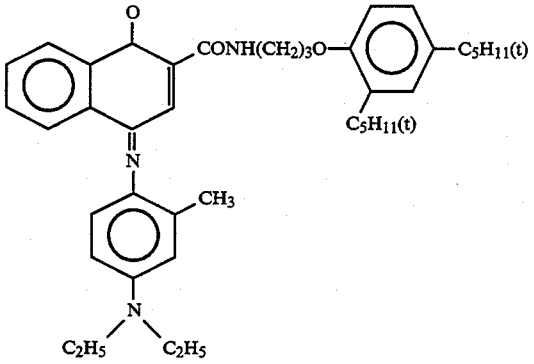
D-5
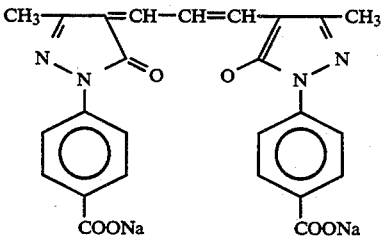
E-1
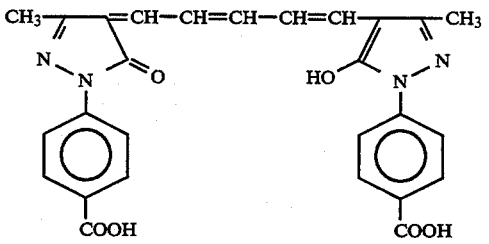
E-2
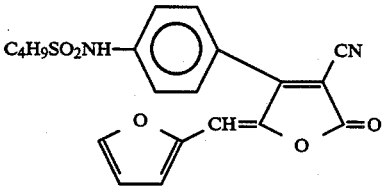

-continued
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2N^{\oplus}(CH_3)_3$
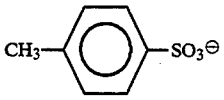
W-2
$C_8F_{17}SO_2N(C_3H_7)CH_2COOK$
W-3
$NaO_3S{-}CH(CH_2COOCH_2CH(C_2H_5)C_4H_9){-}COOCH_2CH(C_2H_5)C_4H_9$
W-4
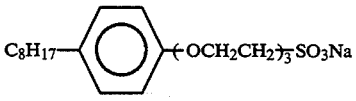
W-5
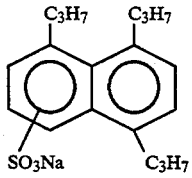
W-6
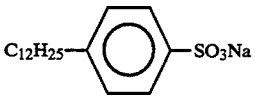
P-1
$\left(CH_2{-}CH(CONHC_4H_9(t))\right)_n$
M-1
$\left(CH_2{-}CH(COOC_4H_9)\right)_n$
F-1
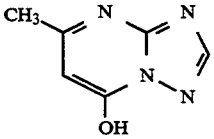
F-2
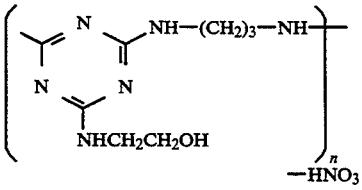
F-3
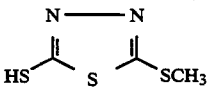
F-4
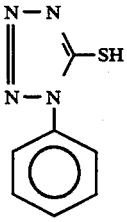

-continued

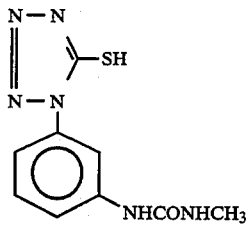

F-5

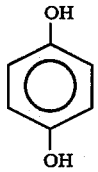

F-6

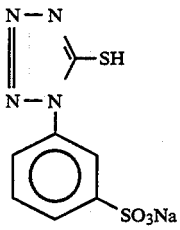

F-7

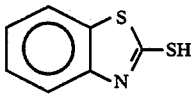

F-8

Samples 102 to 104 were formed by changing the couplers in the 4th, 5th, and 6th layers of the sample as shown in Table 4 below. In Table 4, the unit is mg/m$^2$.

TABLE 4

| Sample No. | 4th layer | 5th layer | 6th layer |
|---|---|---|---|
| 101 | C-1 120 mg/m$^2$ | C-1 120 mg/m$^2$ | C-3 650 mg/m$^2$ |
| | C-2 50 mg/m$^2$ | C-2 50 mg/m$^2$ | |
| | C-6 3.6 mg/m$^2$ | C-6 11 mg/m$^2$ | C-6 54 mg/m$^2$ |
| 102 | C-1 120 mg/m$^2$ | C-1 120 mg/m$^2$ | C-3 650 mg/m$^2$ |
| | C-2 50 mg/m$^2$ | C-2 50 mg/m$^2$ | |
| | C-6 14 mg/m$^2$ | C-6 11 mg/m$^2$ | C-6 14 mg/m$^2$ |
| 103 | C-1 120 mg/m$^2$ | C-1 120 mg/m$^2$ | C-3 650 mg/m$^2$ |
| | C-2 50 mg/m$^2$ | C-2 50 mg/m$^2$ | |
| | C-5 3.7 mg/m$^2$ | C-5 11 mg/m$^2$ | C-5 56 mg/m$^2$ |
| 104 | C-1 120 mg/m$^2$ | C-1 120 mg/m$^2$ | C-3 650 mg/m$^2$ |
| | C-2 50 mg/m$^2$ | C-2 50 mg/m$^2$ | |

A sample 111 was formed by changing the 4th to 6th layers of the sample 101 as shown in Table 5 below.

TABLE 5

| | |
|---|---|
| 4th layer: Low-speed red-sensitive emulsion layer | |
| Emulsion A | silver 0.3 g |
| Emulsion B | 0.2 g |
| Emulsion C | 0.5 g |
| Gelatin | 1.6 g |
| Coupler C-1 | 0.24 g |
| Coupler C-2 | 0.10 g |
| Coupler C-6 | 0.015 g |
| High-boiling organic solvent Oil-2 | 0.2 g |
| Additive P-1 | 0.2 g |
| 5th layer was removed | |
| 6th layer: High-speed red-sensitive emulsion layer | |
| Emulsion D | silver 0.4 g |
| Gelatin | 1.1 g |

TABLE 5-continued

| | |
|---|---|
| Coupler C-3 | 0.65 g |
| Coupler C-6 | 0.054 g |
| Additive P-1 | 0.1 g |

In addition, samples 112 and 113 were formed by changing the couplers in the 4th, 5th, and 6th layers of the sample 111 as shown in Table 6 below. In Table 6, the unit is mg/m$^2$.

TABLE 6

| Sample No. | 4th layer | 5th layer was removed | 6th layer |
|---|---|---|---|
| 111 | C-1 240 mg/m$^2$ | | C-3 650 mg/m$^2$ |
| | C-2 100 mg/m$^2$ | | |
| | C-6 15 mg/m$^2$ | | C-6 54 mg/m$^2$ |
| 112 | C-1 40 mg/m$^2$ | | C-3 650 mg/m$^2$ |
| | C-2 100 mg/m$^2$ | | |
| | C-6 15 mg/m$^2$ | | C-6 56 mg/m$^2$ |
| 113 | C-1 240 mg/m$^2$ | | C-3 650 mg/m$^2$ |
| | C-2 100 mg/m$^2$ | | |

The arrangements of the samples 101 to 104 and 111 to 113 are summarized in Table 7 (to be presented later).

After being stored at a temperature of 30° C. and a humidity of 60% for 14 days, each of the samples 101 to and 111 to 113 was cut into a sheet size and used to 104 photograph several different objects by using a commercially available 4×5-size camera. The photography was performed in the open air at Fuji Photo Film Co. Ltd. Ashigara Factory in Minami Ashigara City, Kanagawa Prefecture, at noon, 2 p.m., 4 p.m., and 5 p.m. under fine weather in the middle of September. The objects photographed were a Macbeth color chart, a Macbeth gray plate, buildings, persons, scenery, trees, and foliage plants. Since slight differences were found in color balance between the individual samples, a color compensating filter was inserted for each sample to correct the color balance such that the gray plate photographed at noon was reproduced in gray.

The following development was performed on the next day of the photography.

| Processing Step | Time | Temperature |
|---|---|---|
| 1st development | 6 min. | 38° C. |
| Washing | 2 min. | 38° C. |
| Reversal | 2 min. | 38° C. |
| Color development | 6 min. | 38° C. |
| Prebleaching | 2 min. | 38° C. |
| Bleaching | 6 min. | 38° C. |
| Fixing | 4 min. | 38° C. |
| Washing | 4 min. | 38° C. |
| Final rinsing | 1 min. | 25° C. |

The compositions of the individual processing solutions were as follows.

| [1st developing solution] | |
|---|---|
| Nitrilo-N,N,N-trimethylene-phosphonic acid pentasodium salt | 1.5 g |
| Diethylenetriaminepentaacetic acid pentasodium salt | 2.0 g |
| Sodium sulfite | 30 g |
| Pottasium hydroquinone-monosulfonate | 20 g |
| Potassium carbonate | 15 g |
| Sodium bicarbonate | 12 g |
| 1-phenyl-4-methyl-4-hydroxymethyl-3-pyrazolidone | 1.5 g |
| Potassium bromide | 2.5 g |
| Potassium thiocyanate | 1.2 g |
| Potassium iodide | 2.0 mg |
| Diethyleneglycol | 13 g |
| Water to make | 1,000 ml |
| pH | 9.60 |

The pH was adjusted by using sulfuric acid or potassium hydroxide.

| [Reversal solution]j | |
|---|---|
| Nitrilo-N,N,N-trimethylene-phosphonic acid pentasodium salt | 3.0 g |
| Stannous chloride dihydrate | 1.0 g |
| P-aminophenol | 0.1 g |
| Sodium hydroxide | 8 g |
| Glacial acetic acid | 15 ml |
| Water to make | 1,000 ml |
| pH | 6.00 |

The pH was adjusted by using acetic acid or sodium hydroxide.

| [Color developing solution] | |
|---|---|
| Nitrilo-N,N,N-trimethylene-phosphonic acid pentasodium salt | 2.0 g |
| Sodium sulfite | 7.0 g |
| Trisodium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-ethyl-N-(β-methanesulfonamido-ethyl)-3-methyl-4-aminoaniline 3/2 sulfuric acid monohydrate | 11 g |
| 3,6-dithiaoctan-1,8-diol | 1.0 g |

-continued

| [Color developing solution] | |
|---|---|
| Water to make | 1,000 ml |
| pH | 11.80 |

The pH was adjusted by using sulfuric acid or sodium hydroxide.

| [Pre-bleaching solution] | |
|---|---|
| Ethylenediaminetetraacetic acid disodium salt dehydrate | 8.0 g |
| Sodium sulfite | 6.0 g |
| 1-thioglycerol | 0.4 g |
| Formaldehyde-sodium bisulfite adduct | 30 g |
| Water to make | 1,000 ml |
| pH | 6.20 |

The pH was adjusted by using acetic acid or sodium hydroxide.

| [Bleaching solution] | |
|---|---|
| Ethylenediaminetetraacetic acid disodium salt dihydrate | 2.0 g |
| Ammonium Fe (III) ethylenediaminetetraacetate dehydrate | 120 g |
| Potassium bromide | 100 g |
| Ammonium nitrate | 10 g |
| Water to make | 1,000 ml |
| pH | 5.70 |

The pH was adjusted by using nitric acid or sodium hydroxide.

| [Fixing solution] | |
|---|---|
| Ammonium thiosulfate | 80 g |
| Sodium sulfite | 5.0 g |
| Sodium bisulfite | 5.0 g |
| Water to make | 1,000 ml |
| pH | 6.60 |

The pH was adjusted by using acetic acid or ammonia water.

| [Final rinsing solution] | |
|---|---|
| 1,2-benzoisothiazolin-3-one | 0.02 g |
| Polyoxyethylene-p-monononyl phenylether (average polymerization degree 10) | 0.3 g |
| Polymaleic acid (average molecular weight 2,000) | 0.1 g |
| Water to make | 1,000 ml |
| pH | 7.0 |

The color reproduction and the color temperature dependency of each processed sample were evaluated by visual sensitive evaluation. The evaluation was performed by five employees of Fuji Photo Film Co. Ltd. Ashigara Laboratory, whose duty was evaluation of photographs. Both the color reproduction and the color temperature dependency were evaluated in accordance with the following five evaluation grades.

| Marks | Evaluation |
|---|---|
| 5 | Very good |

-continued

| Marks | Evaluation |
|---|---|
| 4 | Good |
| 3 | Normal |
| 2 | Poor |
| 1 | Very poor |

The evaluation results of the color reproduction and the color temperature dependency of each sample shown in Table 7 below are represented by average values of the marks given by the five testers.

TABLE 7

| Arrangements and evaluation results of sample 101 to 104 and 111 to 113 | | | | | | | |
|---|---|---|---|---|---|---|---|
| Sample No. | 101 | 102 | 103 | 104 | 111 | 112 | 113 |
| (Arrangement of sample) | | | | | | | |
| 6th layer | | | | | | | |
| Ycp mixing ratio (%) | 8 | 2 | 8 | 0 | 8 | 8 | 0 |
| Ycp relative coupling rate | 1.3 | 1.3 | 0.5 | — | 1.3 | 0.5 | — |
| 5th layer | | | | | | | |
| Ycp mixing ratio (%) | 6 | 6 | 6 | 0 | No 5th layer | No 5th layer | No 5th layer |
| Ycp relative coupling rate | 1.9 | 1.9 | 0.6 | — | | | |
| 4th layer | | | | | | | |
| Ycp mixing ratio (%) | 2 | 8 | 2 | 0 | 4 | 4 | 0 |
| Ycp relative coupling rate | 1.9 | 1.9 | 0.6 | — | 1.9 | 0.6 | — |
| (Evaluation results) | | | | | | | |
| Color reproduction | 4.4 | 3.4 | 4.2 | 4.2 | 3.4 | 3.8 | 3.8 |
| Color temperature dependency | 4.6 | 4.8 | 2.2 | 1.8 | 3.6 | 2.0 | 1.8 |
| Total | 9.0 | 8.2 | 6.4 | 6.0 | 7.0 | 5.8 | 5.6 |

Note:
Ycp means a yellow coupler (the same shall apply in the following tables).

As is apparent from Table 7, each sample of the present invention in which the yellow coupler with a relative coupling rate of 0.7 or more with respect to the cyan coupler was mixed in the red-sensitive emulsion layers was improved in color temperature dependency and also had a good color reproduction. Although the improvement in color reproduction resulting from the mixing of the yellow coupler was unexpected, this improvement was due to increases in fidelities of particularly bluish colors derived from the mixing of the yellow coupler. The effect of improving the color temperature dependency was insignificant when a coupler with a relative coupling rate of less than 0.7 was mixed. In addition, the color temperature dependency could be improved better while the degree of unclear colors was kept low by increasing the mixing ratios of the yellow coupler in red-sensitive emulsion sublayers with higher speeds. Both the color reproduction and the color temperature dependency could be improved significantly by dividing the red-sensitive emulsion layer into three sublayers with different speeds.

EXAMPLE 2

Samples 121,122, and 123 were formed by removing the compounds Cpd-J (exemplified compound 1-36) and Cpd-K (compound of Formula (I)) from the 2nd layers of the samples 101,103, and 104, respectively.

Following the same procedures as in Example 1, the color reproduction and the color temperature dependency of each of the samples 101,103,104, 121,122, and 123 were evaluated. The arrangements and the evaluation results of the individual samples are summarized in Table 8 below.

Note that the date of photography, the objects photographed, and the date of evaluation in Example 2 were different from those in Example 1, so it is inadequate to compare the evaluation results of Example 2 directly with those of Example 1.

TABLE 8

| Arrangements and evaluation results of sample 101, 103, 104, 121, 122, and 123. | | | | | | |
|---|---|---|---|---|---|---|
| Sample No. | 101 | 103 | 104 | 121 | 122 | 123 |
| (Arrangement of sample) | | | | | | |
| 6th layer | | | | | | |
| Ycp mixing ratio (%) | 8 | 8 | 0 | 8 | 8 | 0 |
| Ycp relative coupling rate | 1.3 | 0.5 | — | 1.3 | 0.5 | — |
| 5th layer | | | | | | |
| Ycp mixing ratio (%) | 6 | 6 | 0 | 6 | 6 | 0 |
| Ycp relative coupling rate | 1.9 | 0.6 | — | 1.9 | 0.6 | — |
| 4th layer | | | | | | |
| Ycp mixing ratio (%) | 2 | 2 | 0 | 2 | 2 | 0 |
| Ycp relative coupling rate | 1.9 | 0.6 | — | 1.9 | 0.6 | — |
| Compound represented by Formula (I) | Contained | Contained | Contained | None | None | None |
| (Evaluation results) | | | | | | |
| Color reproduction | 4.4 | 3.4 | 4.2 | 2.8 | 2.6 | 2.6 |
| Color temperature dependency | 4.6 | 4.8 | 2.2 | 4.8 | 2.4 | 2.0 |
| Total | 9.0 | 8.2 | 6.4 | 7.6 | 5.0 | 4.6 |

As can be seen from Table 8, the color reproduction and the color temperature dependency were improved significantly by combining the technique using a compound represented by Formula (I) with the technique of mixing the yellow coupler in the red-sensitive emulsion layers.

EXAMPLE 3

Samples 131 and 132 were formed by changing the silver iodide contents (%) of the individual emulsions contained in the red- and green-sensitive emulsion layers of the sample 101 as shown in Table 9 below.

TABLE 9

| | Red-sensitive emulsion layers | | | | Green-sensitive emulsion layers | | | |
|---|---|---|---|---|---|---|---|---|
| | 4th layer | 5th layer | 6th layer | Average | 9th layer | 10th layer | 11th layer | Average |
| Sample 101 | 4.5 | 4.0 | 2.5 | 3.7 | 3.2 | 3.0 | 2.0 | 2.7 |

TABLE 9-continued

| | Red-sensitive emulsion layers | | | | Green-sensitive emulsion layers | | | |
|---|---|---|---|---|---|---|---|---|
| | 4th layer | 5th layer | 6th layer | Average | 9th layer | 10th layer | 11th layer | Average |
| Sample 131 | 2.9 | 3.5 | 2.5 | 3.0 | 3.5 | 3.5 | 2.0 | 3.0 |
| Sample 132 | 2.9 | 3.0 | 2.5 | 2.8 | 4.5 | 4.0 | 2.5 | 3.7 |

Note:
The average value is the weighted means weighted with coated silver amounts.

A sample 133 was formed by using couplers identical with those in the individual red-sensitive emulsion sublayers of the sample 103 in the red-sensitive emulsion sublayers of the sample 132. In addition, a sample 134 was formed by using couplers identical with those in the individual red-sensitive emulsion sublayers of the sample 104 in the red-sensitive emulsion sublayers of the sample 132.

Following the same procedures as in Example 1, the color reproduction and the color temperature dependency of each of the samples 101,103,104,131,132, 133, and 134 were evaluated. The arrangements and the evaluation results of the individual samples are summarized in Table 10 below.

Note that the date of photography, the objects photographed, and the date of evaluation in Example 3 were different from those in Examples 1 and 2, so it is inadequate to compare the evaluation results of Example 3 directly with those of Examples 1 and 2.

TABLE 10

| Arrangements and evaluation results of samples 101, 103, 104, and 131 to 134 | | | | | | | |
|---|---|---|---|---|---|---|---|
| Sample No. | 101 | 103 | 104 | 131 | 132 | 133 | 134 |
| (Arrangement of sample) | | | | | | | |
| 6th layer | | | | | | | |
| Ycp mixing ratio (%) | 8 | 8 | 0 | 8 | 8 | 8 | 0 |
| Ycp relative coupling rate | 1.3 | 0.5 | — | 1.3 | 1.3 | 0.5 | — |
| 5th layer | | | | | | | |
| Ycp mixing ratio (%) | 6 | 6 | 0 | 6 | 6 | 6 | 0 |
| Ycp relative coupling rate | 1.9 | 0.6 | — | 1.9 | 1.9 | 0.6 | — |
| 4th layer | | | | | | | |
| Ycp mixing ratio (%) | 2 | 2 | 0 | 2 | 2 | 2 | 0 |
| Ycp relative coupling rate | 1.9 | 0.6 | — | 1.9 | 1.9 | 0.6 | — |
| Average silver iodide content (%) of red-sensitive emulsion layers | 3.7 | 3.7 | 3.7 | 3.0 | 2.8 | 2.8 | 2.8 |
| Average silver iodide content (%) of red-sensitive emulsion layers (Evaluation results) | 2.7 | 2.7 | 2.7 | 3.0 | 3.7 | 3.7 | 3.7 |
| Color reproduction | 4.4 | 4.2 | 4.2 | 3.6 | 2.4 | 2.2 | 2.2 |
| Color temperature dependency | 4.6 | 2.2 | 1.8 | 4.6 | 4.8 | 4.8 | 4.8 |
| Total | 9.0 | 6.4 | 6.0 | 8.2 | 7.2 | 7.0 | 7.0 |

As is apparent from Table 10, a high color reproduction and a good color temperature dependency could be realized by increasing the silver iodide contents in the red-sensitive emulsion layers to be higher than those in the green-sensitive emulsion layers and using the yellow coupler with a relative coupling rate of 0.7 or more in the red-sensitive emulsion layers.

EXAMPLE 4

Samples 141 and 142 were formed by changing the emulsions in the 15th and 16th layers of the sample 101 as shown in Table 11 below. A sample 143 was formed by changing the emulsions in the 15th and 16th layers of the sample 103 as shown in Table 11. A sample 144 was formed by changing the emulsions in the 15th and 16th layers of the sample 104 as shown in Table 11.

TABLE 11

| Sample No. | 101 | 103 | 104 | 141 | 142 | 143 | 144 |
|---|---|---|---|---|---|---|---|
| Emulsion of 15th layer | Tabular | Tabular | Tabular | Tabular | Cubic | Cubic | Cubic |
| Diameter/thickness ratio | 3.0 | 3.0 | 3.0 | 3.2 | 1.0 | 1.0 | 1.0 |
| Size distribution (%) | 16% | 16% | 16% | 30% | 15% | 15% | 15% |
| Emulsion of 16th layer | Tabular | Tabular | Tabular | Tabular | Cubic | Cubic | Cubic |
| Diameter/thickness ratio | 4.2 | 4.2 | 4.2 | 4.3 | 1.0 | 1.0 | 1.0 |
| Size distribution (%) | 14% | 14% | 14% | 28% | 12% | 12% | 12% |

Following the same procedures as in Example 1, the color reproduction and the color temperature dependency of each of the samples 101,103,104, 141, 142, 143, and 144 were evaluated. The arrangements and the evaluation results of the individual samples are summarized in Table 12 below.

Note that the date of photography, the objects photographed, and the date of evaluation in Example 4 were different from those in Examples 1, 2, and 3, so it is inadequate to compare the evaluation results of Example 4 directly with those of Examples 1, 2, and 3.

TABLE 12

| Arrangements and evaluation results of samples 101, 103, 104, and 141 to 144 | | | | | | | |
|---|---|---|---|---|---|---|---|
| Sample No. | 101 | 103 | 104 | 141 | 142 | 143 | 144 |
| (Arrangement of sample) | | | | | | | |
| 6th layer | | | | | | | |
| Ycp mixing ratio (%) | 8 | 2 | 0 | 8 | 8 | 8 | 0 |
| Ycp relative coupling rate | 1.3 | 0.5 | — | 1.3 | 1.3 | 0.5 | — |
| 5th layer | | | | | | | |

TABLE 12-continued

| Arrangements and evaluation results of samples 101, 103, 104, and 141 to 144 | | | | | | | |
|---|---|---|---|---|---|---|---|
| Sample No. | 101 | 103 | 104 | 141 | 142 | 143 | 144 |
| Ycp mixing ratio (%) | 6 | 6 | 0 | 6 | 6 | 6 | 0 |
| Ycp relative coupling rate | 1.9 | 0.6 | — | 1.9 | 1.9 | 0.6 | — |
| 4th layer | | | | | | | |
| Ycp mixing ratio (%) | 2 | 2 | 0 | 2 | 2 | 2 | 0 |
| Ycp relative coupling rate | 1.9 | 0.6 | — | 1.9 | 1.9 | 0.6 | — |
| Emulsion of blue-sensitive layer | Mono-dis-perse Tabular | Mono-dis-perse Tabular | Mono-dis-perse Tabular | Poly-dis-perse Tabular | Mono-dis-perse Cubic | Mono-dis-perse Cubic | Mono-dis-perse Cubic |
| (Evaluation results) | | | | | | | |
| Color reproduction | 4.4 | 4.2 | 4.2 | 4.4 | 4.4 | 4.2 | 4.2 |
| Color temperature dependency | 4.6 | 2.2 | 1.8 | 3.8 | 3.2 | 2.8 | 1.6 |
| Total | 9.0 | 6.4 | 6.0 | 8.2 | 7.6 | 6.0 | 5.8 |

As is apparent from Table 12, a high color reproduction and a good color temperature dependency could be realized by using the monodisperse tabular grain emulsions in the blue-sensitive emulsion layers and using the yellow coupler with a relative coupling rate of 0.7 or more in the red-sensitive emulsion layers.

EXAMPLE 5

A sample 151 was formed by removing the yellow coupler from the 4th layer of the sample 101.

A sample 152 was formed by removing the yellow couplers from the 4th and 5th layers of the sample 101.

A sample 153 was formed by removing the yellow coupler from the 6th layer of the sample 101.

A sample 154 was formed by removing the yellow couplers from the 5th and the 6th layers of the sample 101.

Following the same procedures as in Example 1, the color reproduction and the color temperature dependency of each of the samples 101,104, 151,152, 153, and 154 were evaluated.

Each of the samples 151,152,153, and 154 exhibited a better color temperature dependency than that of the sample 104. The characteristics of the color reproduction and the color temperature dependency of each sample were as follows.

That is, the bright blue sky obtained by the sample 151 was too bluish compared to that obtained by the sample 101, so the sample 151 was slightly inferior to the sample 101 in fidelity of color reproduction. In the sample 151, however, the saturations of some bluish colors increased. In the sample 152, the color temperature dependency increased and the bright blue sky was too bluish as compared with those in the samples 101 and 151, indicating that the sample 152 was slightly inferior to the samples 101 and 151 in fidelity of color reproduction. However, the saturations of some bluish colors increased in the sample 151. Although the color temperature dependency of each of the samples 153 and 154 was improved compared to that of the sample 104, the degree of the improvement was unsatisfactory.

The effect of the present invention, therefore, is significant when the yellow coupler is used in red-sensitive emulsion sublayers with higher speeds.

What is claimed is:

1. A silver halide color photographic light-sensitive material comprising red-, green-, and blue-sensitive silver halide emulsion layers on a support, wherein said red-sensitive emulsion layer comprises not less than three sublayers with different speeds, and at least one of said red-sensitive emulsion sublayers contains a cyan coupler and a yellow coupler with a relative coupling rate of 0.7 to 3.0 with respect to said cyan coupler.

2. The light-sensitive material according to claim 1, wherein a ratio of the yellow coupler to all couplers contained in the red-sensitive emulsion layer is 0.3 to 20 mol %.

3. The light-sensitive material according to claim 1, wherein an amount of the yellow coupler in a red-sensitive sublayer having a higher speed is larger than an amount of the yellow coupler in a red-sensitive sublayer having a lower speed.

4. The light-sensitive material according to claim 1, wherein the red-sensitive emulsion sublayers contain a yellow coupler at the following ratio:

$$X(RH) \geqq X(RM) \geqq X(RL)$$

where X(RH) is a content (mol %) of the yellow coupler with respect to all couplers contained in a red-sensitive emulsion sublayer with the highest speed, X(RM) is the content (mol %) of the yellow coupler with respect to all couplers contained in a red-sensitive emulsion sublayer with a medium speed, and X(RL) is the content (mol %) of the yellow coupler with respect to all couplers contained in a red-sensitive emulsion sublayer with the lowest speed.

5. The light-sensitive material according to claim 1, wherein a silver iodide content of a red-sensitive sublayer with the lowest speed is 1.0 to 5 mol % higher than the silver iodide content of a red-sensitive sublayer with the highest speed.

6. The light-sensitive material according to claim 1, wherein at least one layer contains a monodisperse silver halide grain emulsion with a grain diameter/grain thickness ratio of 2 to 8.

7. The light-sensitive material according to claim 1, wherein at least one layer contains a compound represented by Formula (I):

$$A(L)_n\text{-}(G)_m\text{-}(Time)_t\text{-}X \qquad \text{(Formula I)}$$

wherein A represents an oxidation-reduction nucleus or a precursor thereof, which is an atomic group which allows $(Time)_t$-X to split off when the compound is oxidized during photographic development, Time represents a group which releases X after splitting off from an oxidized form of A, X represents a development inhibitor, L represents a divalent linking group, G represents a polarized group, and each of n, m, and t represent 0 or 1.

* * * * *